US008740457B2

(12) United States Patent
MacDonald et al.

(10) Patent No.: US 8,740,457 B2
(45) Date of Patent: Jun. 3, 2014

(54) PAINT TRAY BAG WITH EXTENDED DROP SHEET

(75) Inventors: Vance MacDonald, Calgary (CA); Benjamin Leonard, Calgary (CA)

(73) Assignee: Kovrd Products Inc., Calgary, Alberta (CA)

( * ) Notice: Subject to any disclaimer, the term of this patent is extended or adjusted under 35 U.S.C. 154(b) by 132 days.

(21) Appl. No.: 13/228,730

(22) Filed: Sep. 9, 2011

(65) Prior Publication Data

US 2012/0002904 A1 Jan. 5, 2012

Related U.S. Application Data

(63) Continuation-in-part of application No. PCT/CA2011/000735, filed on Jun. 23, 2011.

(60) Provisional application No. 61/357,569, filed on Jun. 23, 2010.

(51) Int. Cl.

| | |
|---|---|
| ***B65D 30/00*** | (2006.01) |
| ***B65D 33/14*** | (2006.01) |
| ***B65D 30/22*** | (2006.01) |
| ***B65D 33/16*** | (2006.01) |

(52) U.S. Cl.

USPC ..... 383/4; 383/22; 383/38; 383/39; 383/63; 383/65; 5/417; 206/209

(58) Field of Classification Search

CPC ..... A45C 9/10; A45C 3/00; A45C 3/10; A44B 19/16

USPC ..... 383/4, 22, 38, 39, 63, 65; 5/417; 206/209, 361, 229; 220/570

See application file for complete search history.

(56) References Cited

U.S. PATENT DOCUMENTS

| | | | | | |
|---|---|---|---|---|---|
| 2,004,320 | A | * | 6/1935 | Hanson | 206/209 |
| 2,105,319 | A | * | 1/1938 | Hedden et al. | 190/1 |
| 3,011,682 | A | | 12/1961 | Kus | |
| 3,143,748 | A | * | 8/1964 | Manning | 5/420 |
| 3,286,826 | A | * | 11/1966 | Stoll | 294/1.3 |
| 3,406,812 | A | | 10/1968 | Henry | |
| 3,757,990 | A | * | 9/1973 | Buth | 220/570 |

(Continued)

FOREIGN PATENT DOCUMENTS

| | | | | |
|---|---|---|---|---|
| FR | 2666493 | A1 * | 3/1992 | A45F 4/00 |

OTHER PUBLICATIONS

PCT International Application No. PCT/CA2011/000735 Search Report received Oct. 20, 2011.

*Primary Examiner* — J. Gregory Pickett
*Assistant Examiner* — Latrice Byrd
(74) *Attorney, Agent, or Firm* — Perry + Currier Inc.

(57) ABSTRACT

A paint tray bag is provided. The paint tray bag comprises a bag comprising dimensions for containing a paint tray, and optionally painting tools, therein. The paint tray bag further comprises a sealing apparatus for releasably sealing the bag, the sealing apparatus around at least portion of a perimeter of the bag such that the bag comprises a closed position for containing the paint tray therein when the sealing apparatus is closed and an open position when the sealing apparatus is open, the bag enabled to lay flat in the open position to act as a drop sheet for the paint tray. The paint tray bag further comprises an extended drop sheet which unfolds from the bag to provide an extended area for the drop sheet.

20 Claims, 19 Drawing Sheets

(56) References Cited

U.S. PATENT DOCUMENTS

| | | | | | |
|---|---|---|---|---|---|
| 3,818,962 | A * | 6/1974 | Muller-Scherak | 383/3 |
| 4,154,323 | A * | 5/1979 | Sneider | 190/2 |
| 4,164,275 | A * | 8/1979 | Davis | 190/2 |
| 4,188,988 | A * | 2/1980 | Agyagos | 383/4 |
| 4,325,323 | A * | 4/1982 | Rioux | 118/504 |
| 4,363,433 | A * | 12/1982 | Jaques | 224/674 |
| 4,388,958 | A | 6/1983 | Dworkin | |
| 4,436,217 | A * | 3/1984 | Ritter | 220/736 |
| 4,491,234 | A * | 1/1985 | Wilcock | 220/697 |
| 4,541,542 | A * | 9/1985 | Florentino | 220/570 |
| 4,765,123 | A * | 8/1988 | Caldwell | 53/459 |
| 4,846,100 | A * | 7/1989 | Montoya | 118/504 |
| 4,934,833 | A * | 6/1990 | Linder | 383/4 |
| 5,007,143 | A | 4/1991 | Herrington | |
| 5,110,219 | A * | 5/1992 | Lopes | 383/4 |
| 5,137,154 | A | 8/1992 | Cohen | |
| 5,316,137 | A * | 5/1994 | Kyllonen | 206/209 |
| 5,439,153 | A * | 8/1995 | Murdoch et al. | 224/658 |
| 5,653,337 | A * | 8/1997 | Cirigliano | 206/373 |
| 5,664,299 | A | 9/1997 | Porchia et al. | |
| 5,759,275 | A * | 6/1998 | Shostak | 118/504 |
| 5,787,544 | A * | 8/1998 | Meade | 15/257.06 |
| 5,871,280 | A | 2/1999 | Watters | |
| 5,887,708 | A * | 3/1999 | Gonzales | 206/209 |
| 5,942,311 | A | 8/1999 | Scianna | |
| 6,053,634 | A | 4/2000 | Kay | |
| 6,276,828 | B1 * | 8/2001 | Otley et al. | 383/4 |
| 6,393,638 | B1 * | 5/2002 | MacColl | 5/419 |
| 6,493,891 | B1 * | 12/2002 | Livingston | 5/636 |
| 6,502,693 | B1 * | 1/2003 | Percival | 206/223 |
| 6,634,041 | B2 * | 10/2003 | Higashi et al. | 5/417 |
| 6,793,991 | B2 * | 9/2004 | Thuma et al. | 428/34.1 |
| 6,971,420 | B2 * | 12/2005 | Demitry | 141/88 |
| 7,058,997 | B1 * | 6/2006 | Klinger | 5/413 R |
| 7,225,483 | B1 * | 6/2007 | Remblad | 5/417 |
| 7,537,111 | B2 * | 5/2009 | Hart et al. | 206/209 |
| 7,611,009 | B2 * | 11/2009 | Youngs | 206/81 |
| 7,752,998 | B1 * | 7/2010 | Noble | 118/504 |
| 8,016,484 | B1 * | 9/2011 | Cross | 383/4 |
| 2002/0074251 | A1 * | 6/2002 | Hirshberg | 206/315.1 |
| 2002/0114539 | A1 * | 8/2002 | Strevey et al. | 383/13 |
| 2004/0123386 | A1 * | 7/2004 | Higashi et al. | 5/420 |
| 2004/0134917 | A1 * | 7/2004 | Carnegie | 220/570 |
| 2005/0006262 | A1 * | 1/2005 | Jimenez | 206/361 |
| 2005/0039260 | A1 * | 2/2005 | Tyler | 5/417 |
| 2005/0039261 | A1 * | 2/2005 | Corral | 5/417 |
| 2005/0071920 | A1 * | 4/2005 | Higashi et al. | 5/417 |
| 2006/0026758 | A1 * | 2/2006 | Corral | 5/420 |
| 2006/0054527 | A1 * | 3/2006 | Hart et al. | 206/459.5 |
| 2007/0113338 | A1 * | 5/2007 | Remblad | 5/420 |
| 2007/0122066 | A1 * | 5/2007 | Landay | 383/16 |
| 2007/0138222 | A1 * | 6/2007 | Goldman | 224/401 |
| 2007/0258662 | A1 * | 11/2007 | Venditti | 383/4 |
| 2008/0107855 | A1 * | 5/2008 | Everett | 428/43 |
| 2009/0078602 | A1 * | 3/2009 | White | 206/361 |
| 2009/0180715 | A1 * | 7/2009 | Wittke-Kothe | 383/4 |
| 2009/0205980 | A1 * | 8/2009 | Hart et al. | 206/209 |
| 2009/0266822 | A1 | 10/2009 | Rankins | |
| 2010/0092108 | A1 * | 4/2010 | Figlietti | 383/4 |
| 2010/0122395 | A1 * | 5/2010 | Wall et al. | 2/84 |
| 2011/0013856 | A1 * | 1/2011 | Gilbert | 383/4 |
| 2011/0249914 | A1 * | 10/2011 | Boruff | 383/4 |

* cited by examiner

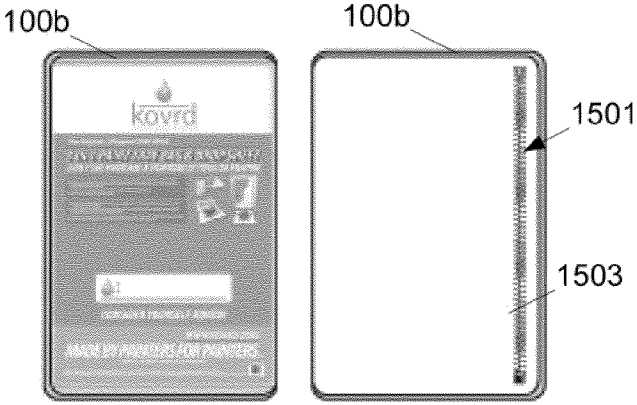
Fig. 15B
Fig. 15A
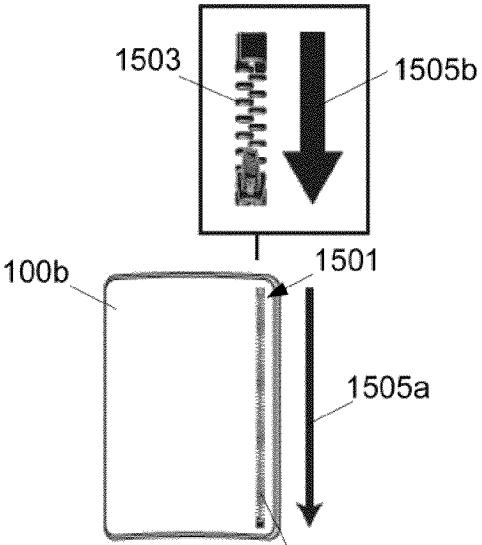
Fig. 15C
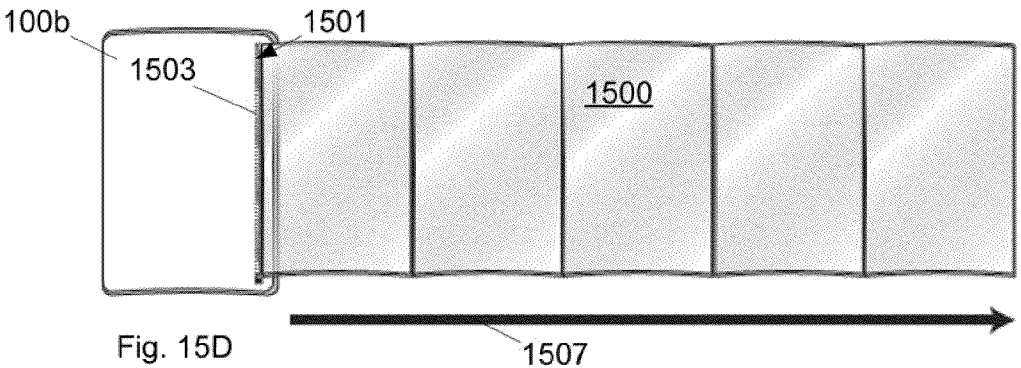
Fig. 15D

PAINT TRAY BAG WITH EXTENDED DROP SHEET

CROSS-REFERENCE TO RELATED APPLICATION

This application is a continuation-in-part of PCT application PCT/CA2011/000735 with an international filing date of Jun. 23, 2011, which is still pending and claims the benefit of 35 U.S.C. 119(e) of U.S. provisional application 61/357,569 filed Jun. 23, 2010, now abandoned. The disclosures of these earlier filed PCT and US provisional applications are herein incorporated by reference.

FIELD

The specification relates generally to painting accessories and specifically to a paint tray bag that includes can convert to an extended drop sheet.

BACKGROUND

Often times a painter using a paint tray will need to stop before a job is completed and clean the paint tray and brush (es)/rollers of paint to prevent the paint from drying out, only to pour the paint back into the tray when continuing the job.

SUMMARY

An aspect of the specification provides a paint tray bag, comprising: a bag comprising dimensions for containing a paint tray therein; a sealing apparatus for releasably sealing the bag, the sealing apparatus around at least portion of a perimeter of the bag such that the bag comprises a closed position for containing the paint tray therein when the sealing apparatus is closed and an open position when the sealing apparatus is open, the bag enabled to lay flat in the open position to act as a drop sheet for the paint tray; and an extended drop sheet portion attached to the bag, the extended drop sheet portion enabled to be stored in the bag and unfold from the bag to provide an extended area for the drop sheet.

The extended drop sheet portion can be enabled to be stored in the bag within a pouch. The pouch can be one of: at a front of the bag and at a back of the bag, such that the extended drop sheet can be accessed when the bag is in the closed position. The pouch can be located inside the bag, such that the extended drop sheet can be accessed when the bag is in the open position. The paint tray bag can further comprise a second sealing apparatus for releasably sealing the pouch when the extend drop sheet is in the pouch. The second sealing apparatus can comprises at least one of a frictional sealing apparatus, an elastic sealing apparatus, a watertight sealing apparatus, an airtight sealing apparatus, a ziplock, a zipper apparatus, a slider apparatus, a press and seal apparatus, Velcro™, and complimentary loop and hook apparatus.

The extended drop sheet can be further enabled to be stored in a folded position in the bag.

The extended drop sheet can be further enabled to unfold from the bag in a straight line.

The extended drop sheet can be further enabled to first unfold from the bag in a straight line and then unfold perpendicularly from the straight line.

The extended drop sheet can be further enabled to unfold around the bag. Edges of the extended drop sheet that unfold around the bag cab be enabled to be releasably attachable to complimentary edges of the bag. The edges of the extended drop sheet and the complimentary edges of the bag can comprise at least one of Velcro™ and complimentary loop and hook apparatus.

The paint tray can further comprise one or more pockets, each of the one or more pockets enabled to contain at least one of a paint brush and painting accessories, such that when at least one of the paint brush and the painting accessories are wet with paint, the pocket prevents the paint from drying. The paint tray bag can further comprise respective sealing apparatus for releasably sealing each of the one or more pockets. The respective sealing apparatus can comprises at least one of a frictional sealing apparatus, an elastic sealing apparatus, a watertight sealing apparatus, an airtight sealing apparatus, a ziplock, a zipper apparatus, a slider apparatus, a press and seal apparatus, Velcro™, and complimentary loop and hook apparatus. The one or more pockets can be located at one or more of at a front of the bag, at a back of the bag, and inside the bag.

The bag can comprise a length between 10 and 60 inches and a width between 10 and 60 inches. The bag can comprise a length of approximately 30 inches and a width of approximately 20 inches.

A material of the bag can be approximately 0.01 inches to approximately 0.1 inches thick.

The paint tray bag can further comprise a handle for at least one of hanging the bag and carrying the bag.

BRIEF DESCRIPTIONS OF THE DRAWINGS

Implementations are described with reference to the following figures, in which:

FIG. 15A depicts a front view of a paint tray bag in a closed position, according to non-limiting implementations.

FIG. 15B depicts a rear view of the paint tray bag of FIG. 15A bag in a closed position, according to non-limiting implementations.

FIG. 15C depicts detail of a sealing apparatus of the paint tray bag of FIG. 1, and further shows a direction for opening sealing apparatus, according to non-limiting implementations.

FIG. 15D depicts the paint tray bag of FIG. 15A with an extended drop sheet portion extending there from, according to non-limiting implementations.

DETAILED DESCRIPTION OF THE IMPLEMENTATIONS

Figure 1:
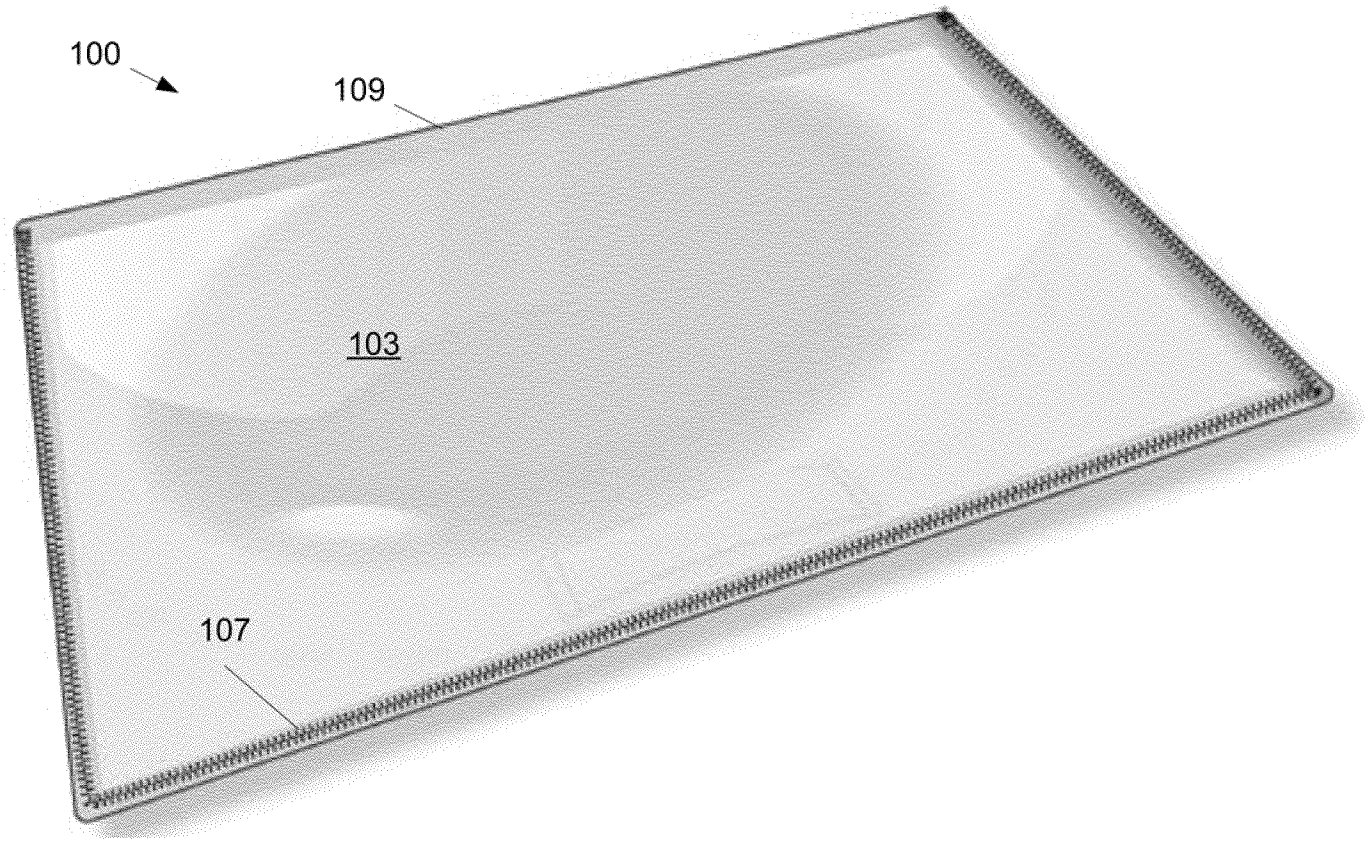
FIG. 1 depicts a paint tray bag in a closed position, according to non-limiting implementations.
Figure 2:
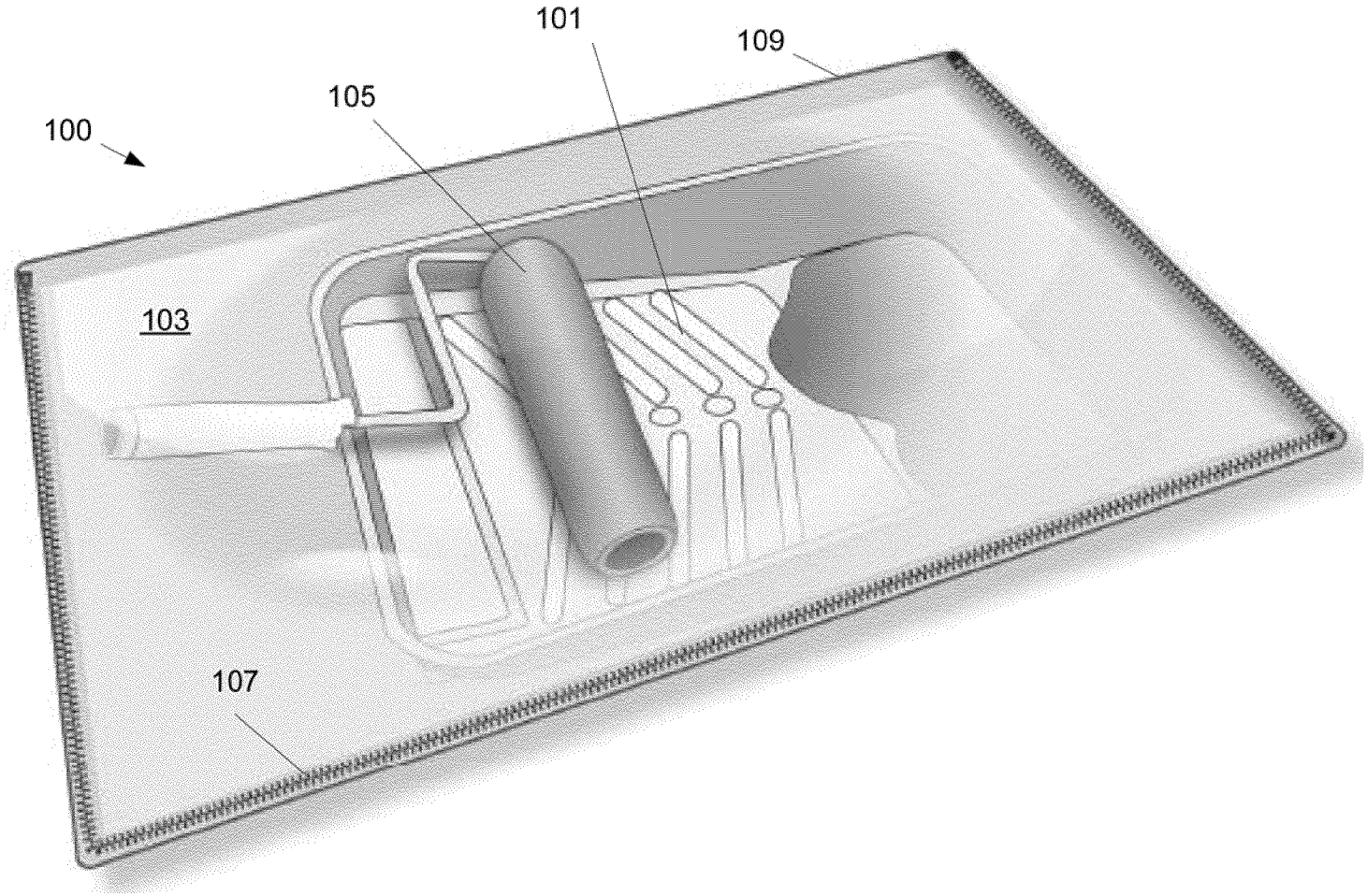
FIG. 2 depicts a paint tray bag in a closed position and paint tray and brush stored therein, according to non-limiting implementations.
Figure 3:
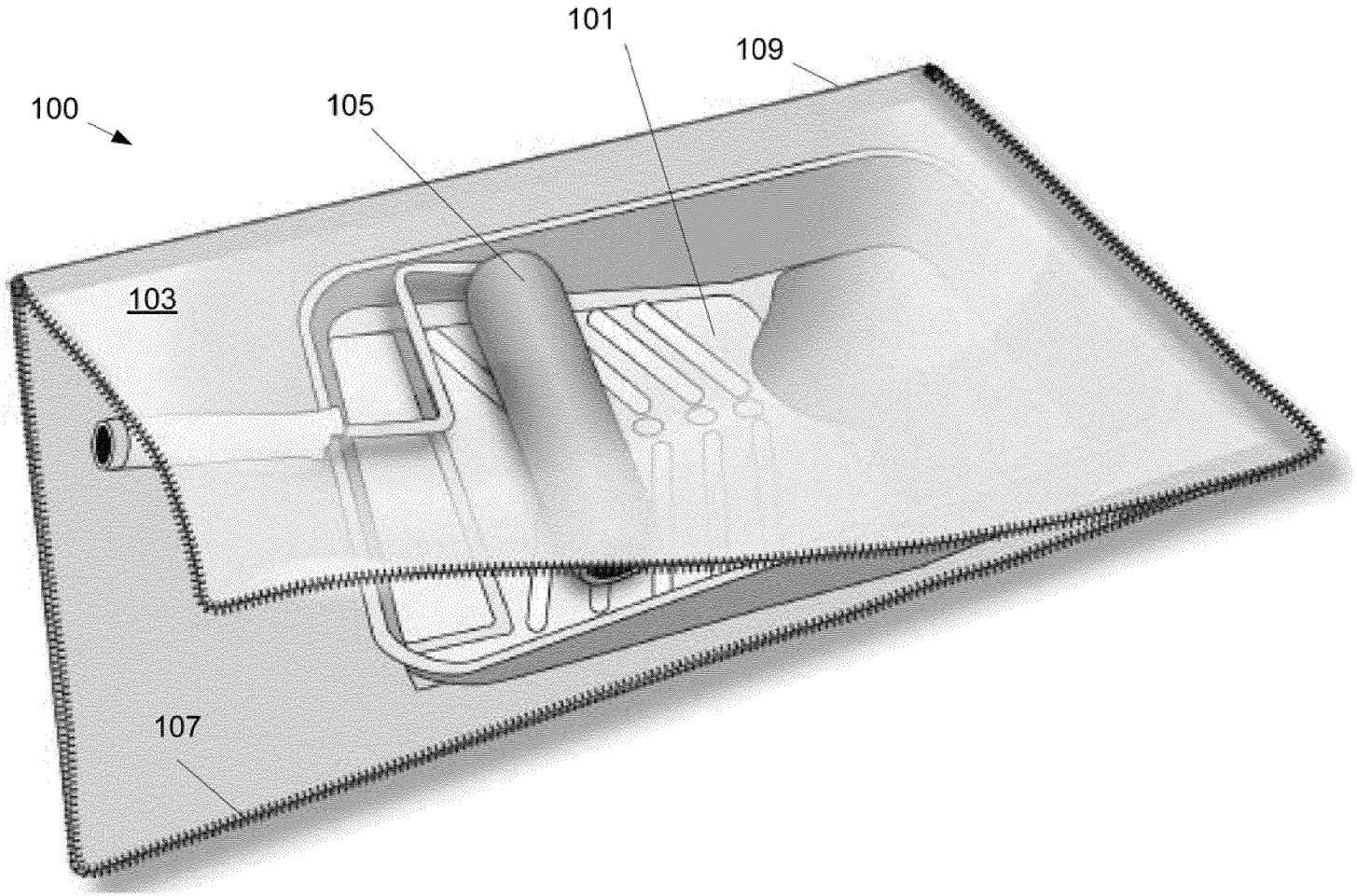
FIG. 3 depicts a paint tray bag in a partially open position, according to non-limiting implementations.
Figure 4:
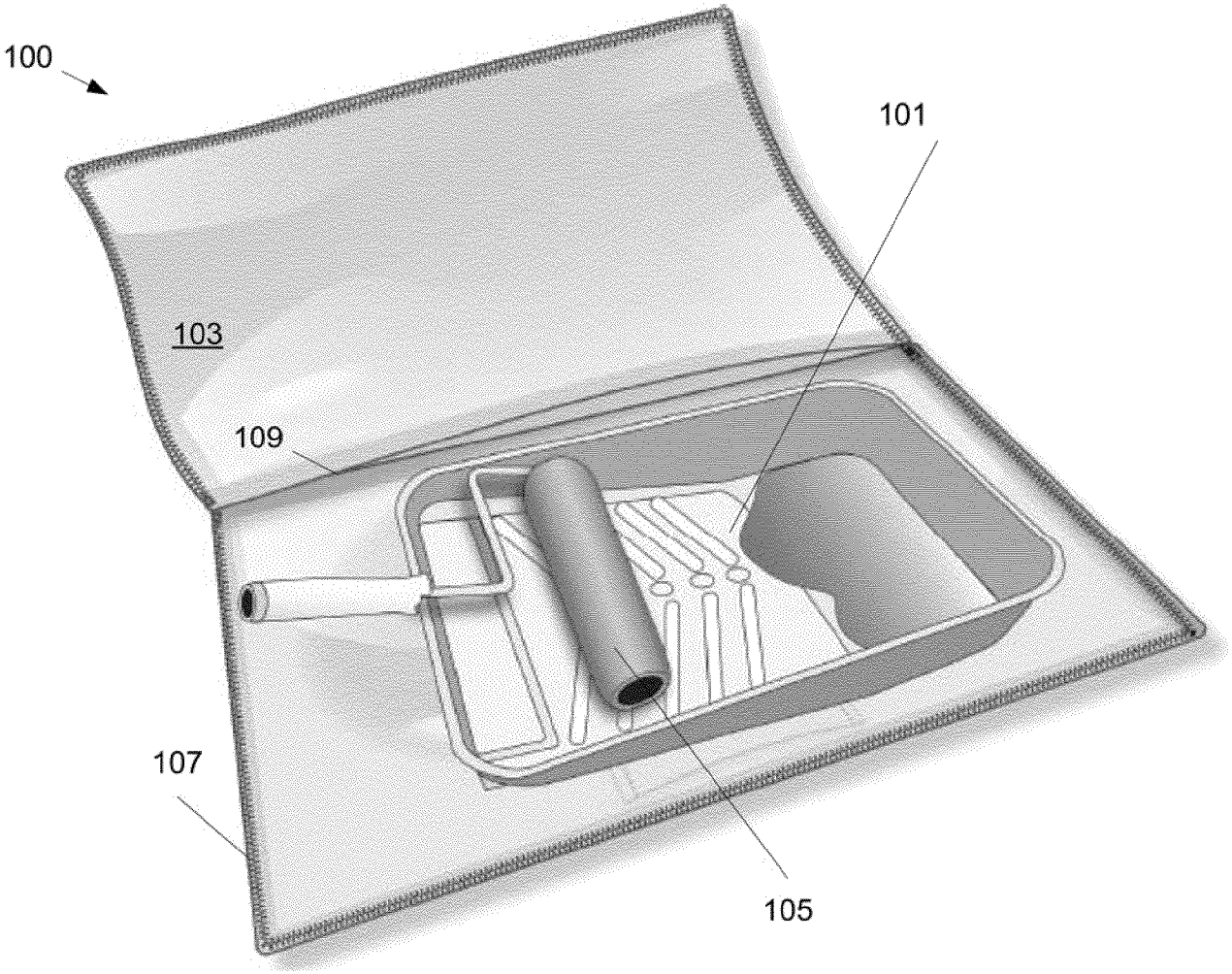
FIG. 4 depicts a paint tray bag in an open position, according to non-limiting implementations.
Figure 5:
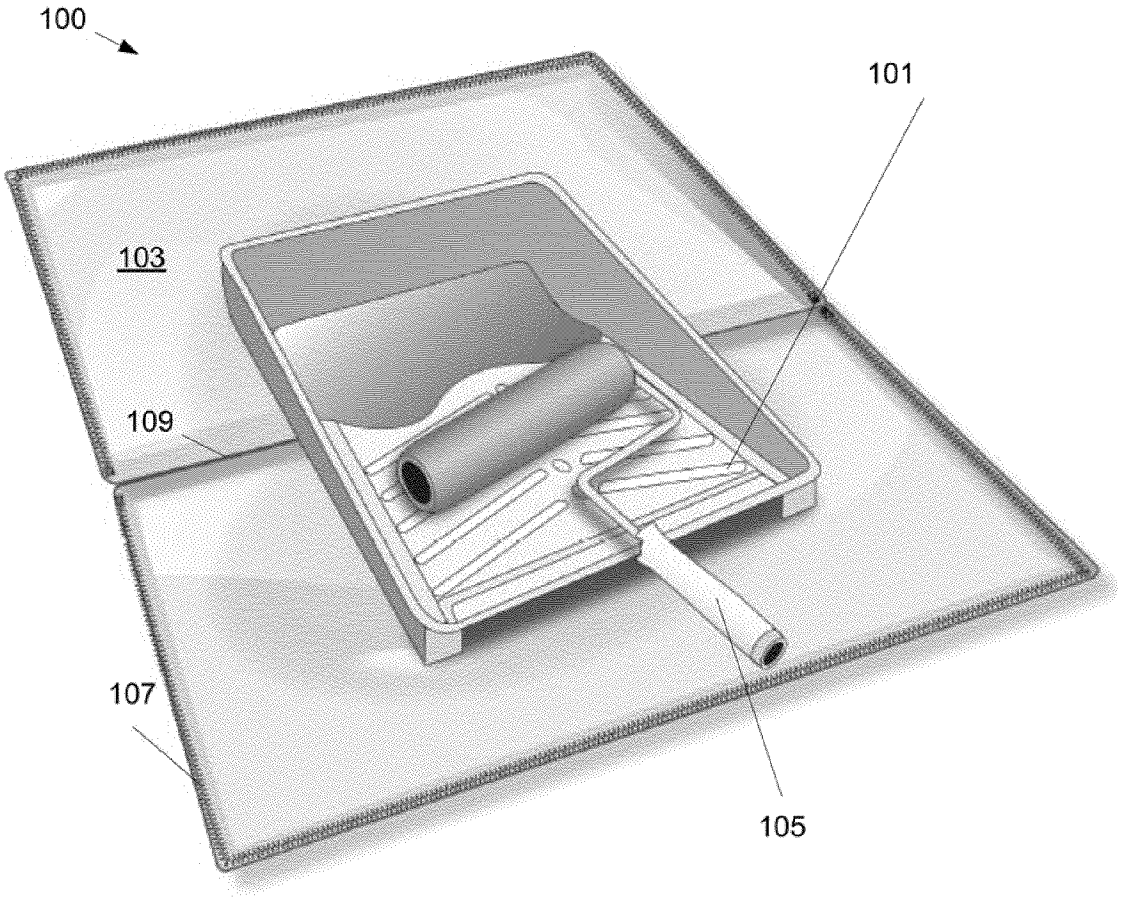
FIG. 5 depicts a paint tray bag in an open position used as a drop sheet for a paint tray, according to non-limiting implementations.

FIGS. 1 and 2 depict a paint tray bag 100 enabled to contain therein at least a paint tray 101, according to non-limiting implementations. Paint tray bag 100 comprises a bag 103 comprising dimensions for containing at least paint tray 101 therein. In some implementations, bag 103 comprises dimensions for containing paint tray 101 and any suitable number of painting accessories associated with paint tray 101, such as a roller 105 or a brush (not depicted). Paint tray bag 100 further comprises a sealing apparatus 107 for releasably sealing bag 103. In some implementations, sealing apparatus 107 extends along one side of paint tray bag 100 such that a paint tray and/or painting accessories or the like can be sealed in paint tray bag 100. However, in depicted implementations, sealing apparatus 107 is generally disposed around at least portion of a perimeter of bag 103. It is appreciated that bag 103 comprises a closed position and an open position, sealing apparatus 107 sealing bag 100 in the closed position. Further, in the closed position, as depicted in FIGS. 1 and 2, bag 103 can contain at least paint tray 101 therein when sealing apparatus 107 is closed. Sealing apparatus 107 is enabled to open, such that bag 103 changes from the closed position of FIGS. 1 and 2 to a partially open position depicted in FIG. 3 and then to an open position depicted in FIGS. 4 and 5, according to non-limiting implementations. Hence, bag 103 further comprises the open position of FIGS. 4 and 5 when sealing apparatus 107 is open. As depicted in FIG. 5, bag 103 is further enabled to lay flat in the open position to act as a drop sheet for paint tray 101.

Bag 103 can be of any suitable dimensions for containing at least paint tray 101. In some implementations, bag 103 can be generally rectangular, though the shape of bag 103 can be any suitable shape. For example, bag 103 can have rounded corners, and/or be generally elliptical and/or circular in shape, or any other suitable shape. In yet further implementations bag 103 can comprise gussets that can accommodate corners and depth of paint tray 101 in the closed position. In some implementations, bag 103 has a length between approximately 25 and approximately 50 inches and a width between approximately 15 and approximately 35 inches. In particular non-limiting implementations, bag 103 has a length of approximately 30 inches and a width of approximately 20 inches in the closed position. Hence, when bag 103 is in the open position, bag 103 has dimensions of approximately 30 inches by approximately 40 inches (i.e. to act as a drop sheet of approximately 30 inches by approximately 40 inches).

It is thus appreciated that paint tray bag 100 in the open position functions as a drop sheet (that is approximately square or rectangular as desired), and that paint tray 101 can conveniently be placed in the middle of the drop sheet to better catch drips and spills that would otherwise come in contact with a floor or other surfaces where spills etc. are unwanted. In other words, paint tray bag 100 conveniently converts from a storage bag for a paint tray 101 to a protective drop sheet that is created by completely opening sealing apparatus 107, so that a top side of bag 103 acts as a flap that can be lifted away from a bottom side of bag 103 like a mirror image laying flat under paint tray 101, thus protecting the floor or other surfaces from potential spills and roller spray off. As painters typically purchase drop sheets separately to put under their equipment to protect the floors from paint, paint tray bag 100 obviates the need to purchase drop sheets for under paint tray 101, as well as acting as storage for paint tray 101 to obviate clean up before a painting job is completed.

As depicted in FIGS. 1 to 5, in implementations where bag 103 is rectangular, sealing apparatus 107 can run around at least three edges of bag 103, such that bag 103 folds along a fourth edge 109 to place bag 103 in the open position. In other words, at least a portion of fourth edge 109 remains closed, fourth edge 109 acting as a hinge point to open bag into a drop sheet. In other implementations, sealing apparatus can extend partially into fourth edge 109, for example so as to better accommodate folding bag over 103 into the open position.

As depicted in FIGS. 1 to 7, in some implementations, sealing apparatus 107 runs across a first short edge of bag 103, along a first long edge of bag 103 and then back across a second short edge of bag 103, such that bag 103 folds along a second long edge (i.e. edge 109) in the open position.

However, as described below with reference to FIGS. 8 to 13, present implementations include a paint tray bag 100*a* that comprises a sealing apparatus 107*a* that runs across a first long edge of a bag 103*a*, along a first short edge of bag 103*a* and then back across a second long edge of bag 103*a*, such that bag 103*a* folds along a second short edge 109*a* in the open position.

In yet further embodiments, sealing apparatus 107 and/or sealing apparatus 107*a* can run around any suitable number of edges, leaving at least a portion of an edge of bag 103 or bag 103*a* intact so that bag 103 and/or bag 103*a* can fold along the portion to lay flat and act as a drop sheet for a paint tray.

Sealing apparatus 107 can comprise any suitable sealing apparatus for releasably sealing bag 103, including but not limited to a ziplock, a zipper apparatus, a slider apparatus, a press and seal apparatus or the like.

Figure 6:
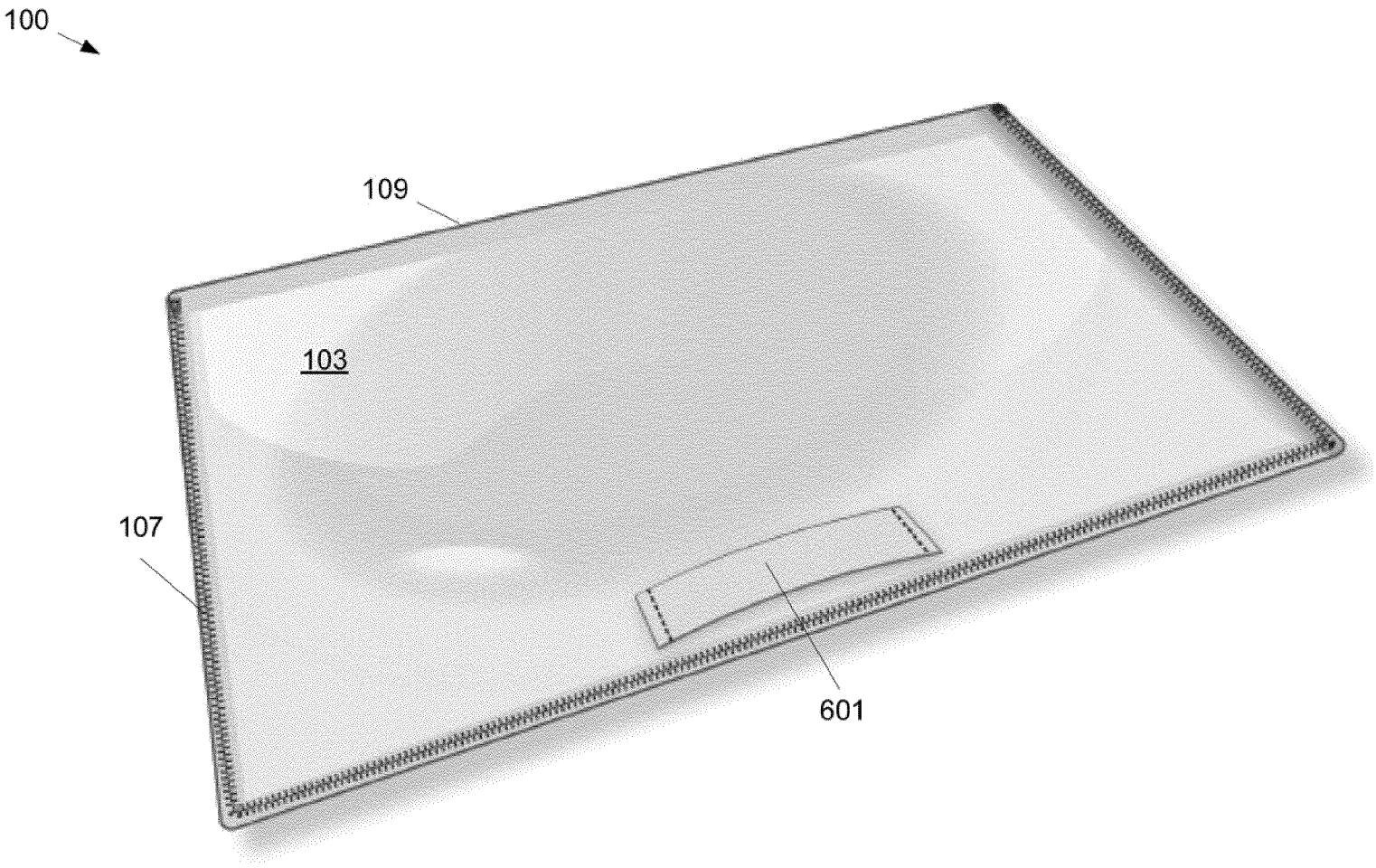
FIG. 6 depicts a handle on a paint tray bag, according to non-limiting implementations.

Attention is now directed to FIG. 6 which depicts an optional handle 601 attached to bag 103. Handle 601 enables paint tray bag 100 for carrying (e.g. by grasping handle 601) and/or for hanging paint tray bag 601 from a hook or the like. In some implementations, handle 601 can enable paint tray bag 100 to be carried while a paint tray, and/or other paint accessories, is contained therein. While FIG. 6 depicts handle 601 as flat on a given side of bag 103, in other implementations handle 601 can extend over an edge of bag 103. It is further appreciated that handle 601 can comprises any suitable dimensions. In depicted non-limiting implementations, handle 601 comprises dimensions of approximately 1 inch by 6 inches.

Bag 103 can comprise of any suitable material, for example any suitable plastic, biodegradable material, rubber, fabric, cellulose, foil, impermeable material or the like, and/or combinations thereof. In some implementations, a bag 103 can comprise transparent material such that paint tray 101 can be viewed when sealed inside bag 103. As bag 103 is generally appreciated to be impermeable, when paint tray 101 is sealed inside bag 103, paint contained therein does not dry out. Further paint spilled on bag 103, when bag 103 is being used as a drop sheet, will not soak through to a surface under bag 103.

In some implementations, bag 103 can comprise a non-slip material to prevent paint tray bag 100 from slipping on slippery surface, such as rugs or wooden floors. For example, in some implementation bag 103 can comprise a non-slip PVC (poly-vinyl chloride) and/or rubber and/or non-slip plastic material and the like. Alternatively, paint tray bag 100 can comprise non-slip material (e.g. non-slip PVC and/or rubber and/or non-slip plastic material and/or tacky material or the like) applied to any suitable number of corners, on both the front and back sides, such that at least the corners of paint tray bag 100 have improved non-slip properties. When the non-slip material is at all four corners of the front and back sides of paint tray bag 100, paint tray bag 100 is provided with eight non-slip areas in the open position. Alternatively, the non-slip material can run along the edges of paint tray bag 100. In general it is appreciated that the location of the non-stick material is generally non-limiting and the non-stick material can be located in any suitable position on the front and/or back surface to prevent paint tray bag 100 from slipping. In yet further implementations, the non-slip material can comprise Velcro™ or the like, and specifically Velcro™ hooks, such that the Velcro™ hooks can releasably attach to a carpet, rug or the like.

Figure 7:
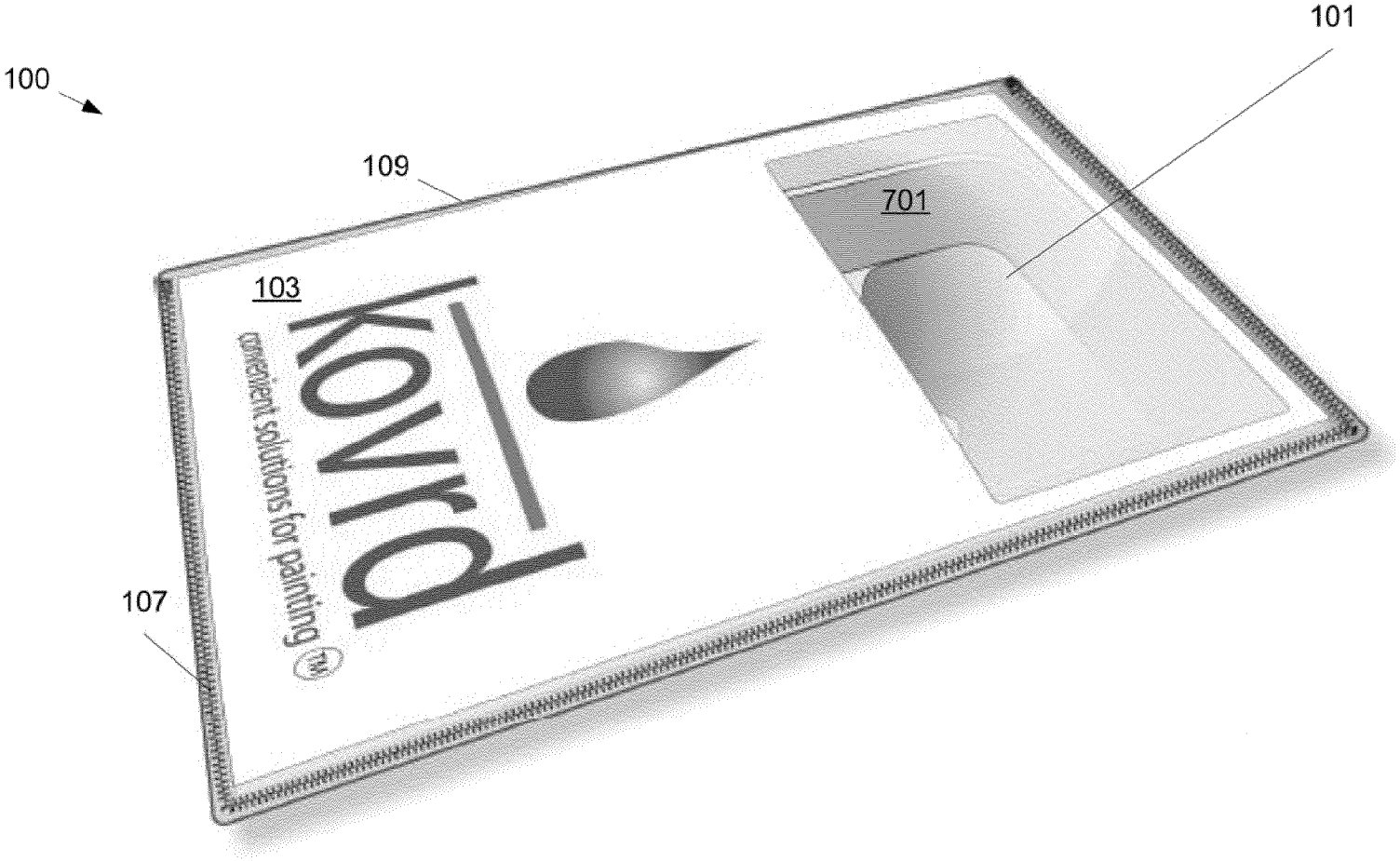
FIG. 7 depicts a window of paint tray bag, according to non-limiting implementations.
Figure 8:
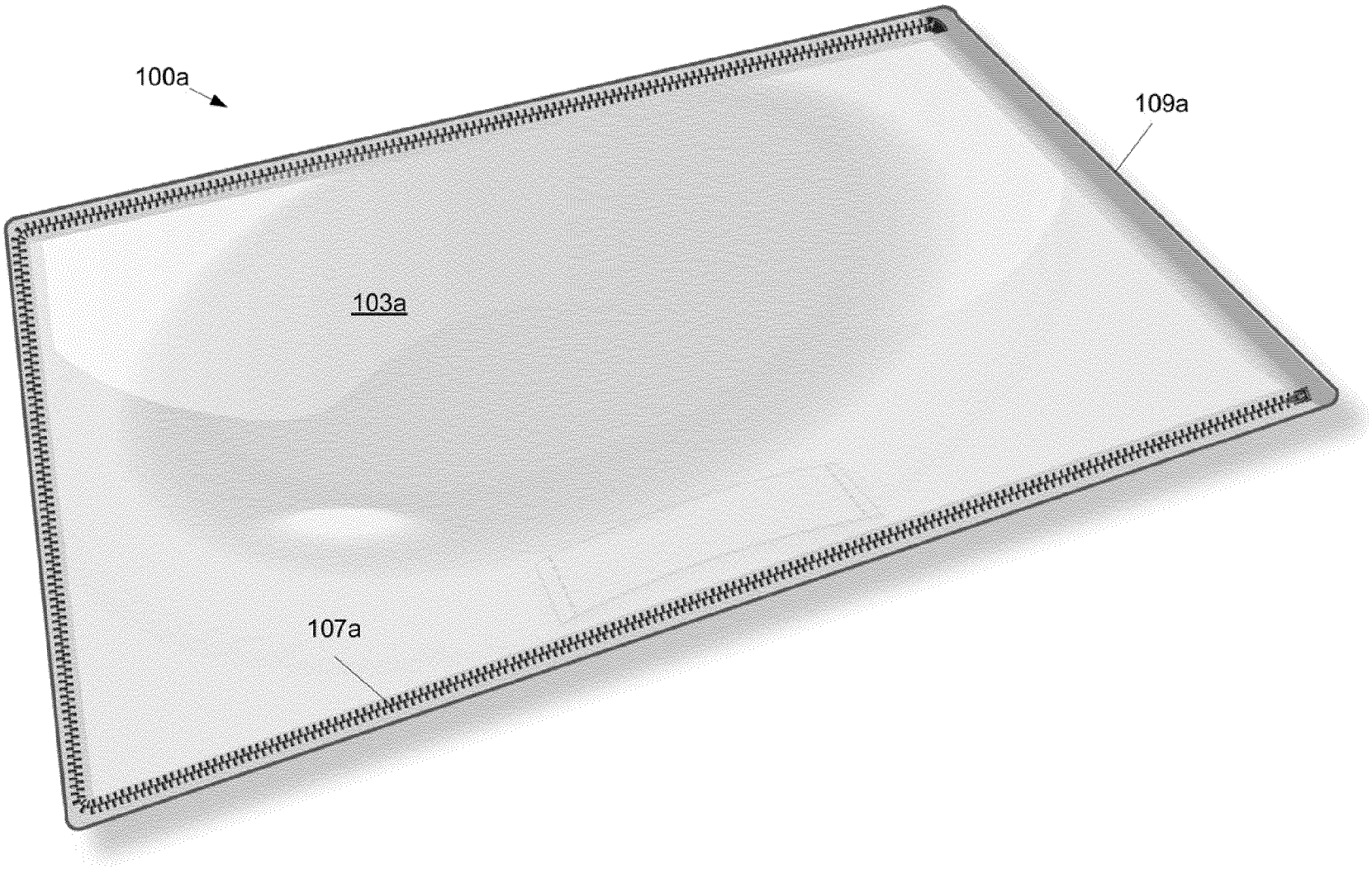
FIG. 8 depicts a paint tray bag in a closed position, according to non-limiting implementations.
Figure 9:
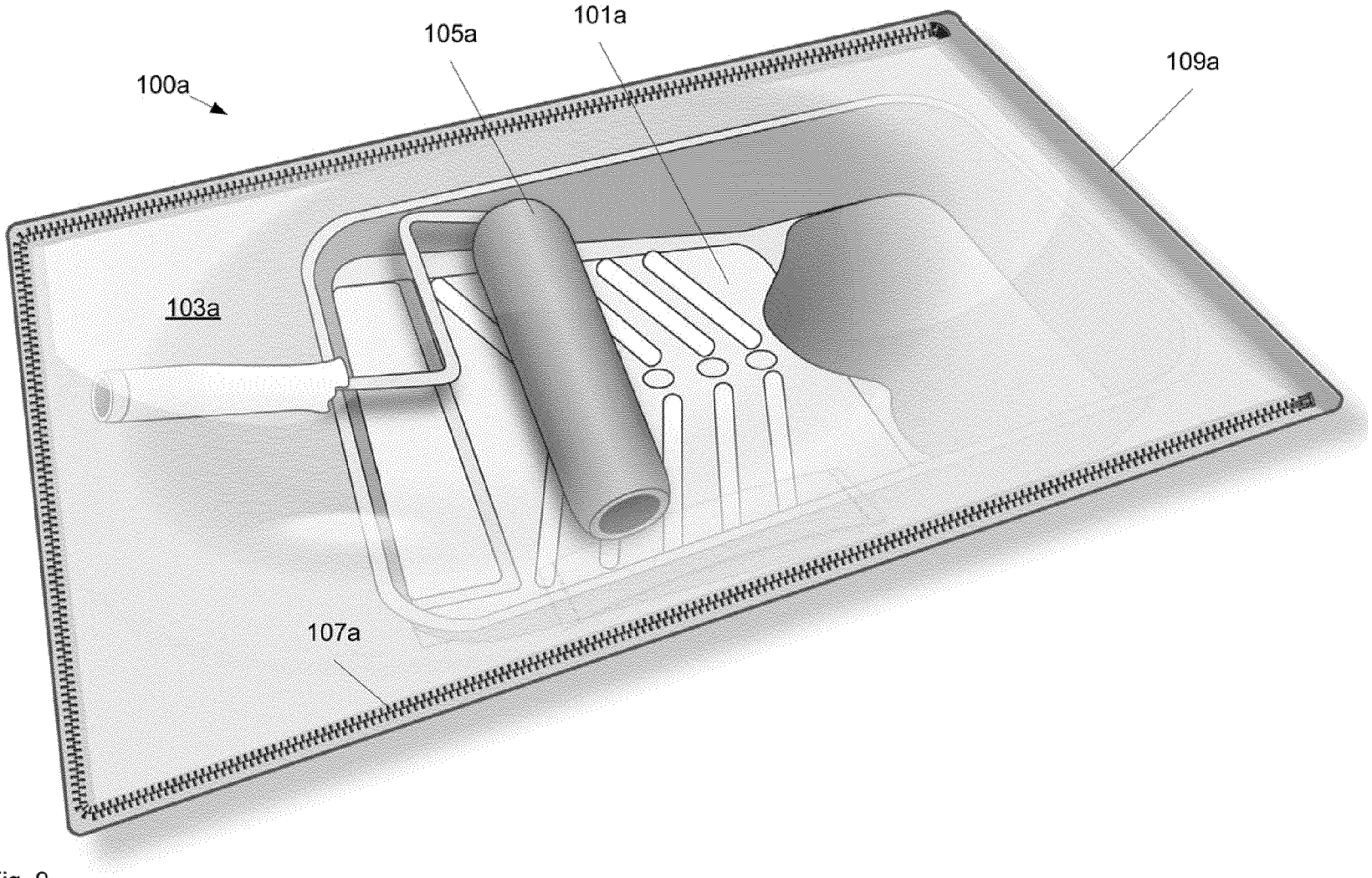
FIG. 9 depicts a paint tray bag in a closed position and paint tray and brush stored therein, according to non-limiting implementations.
Figure 10:
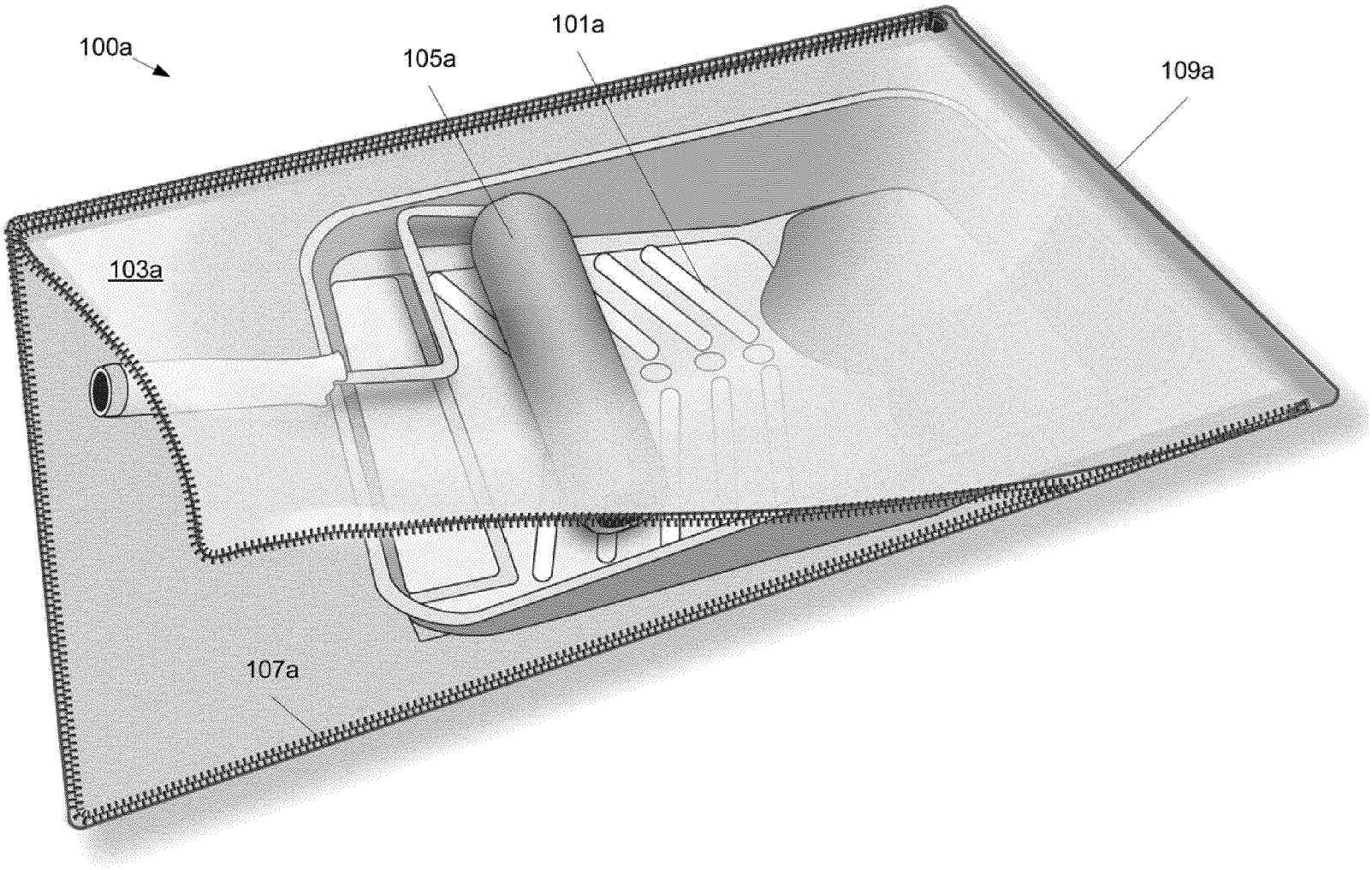
FIG. 10 depicts a paint tray bag in a partially open position, according to non-limiting implementations.
Figure 11:
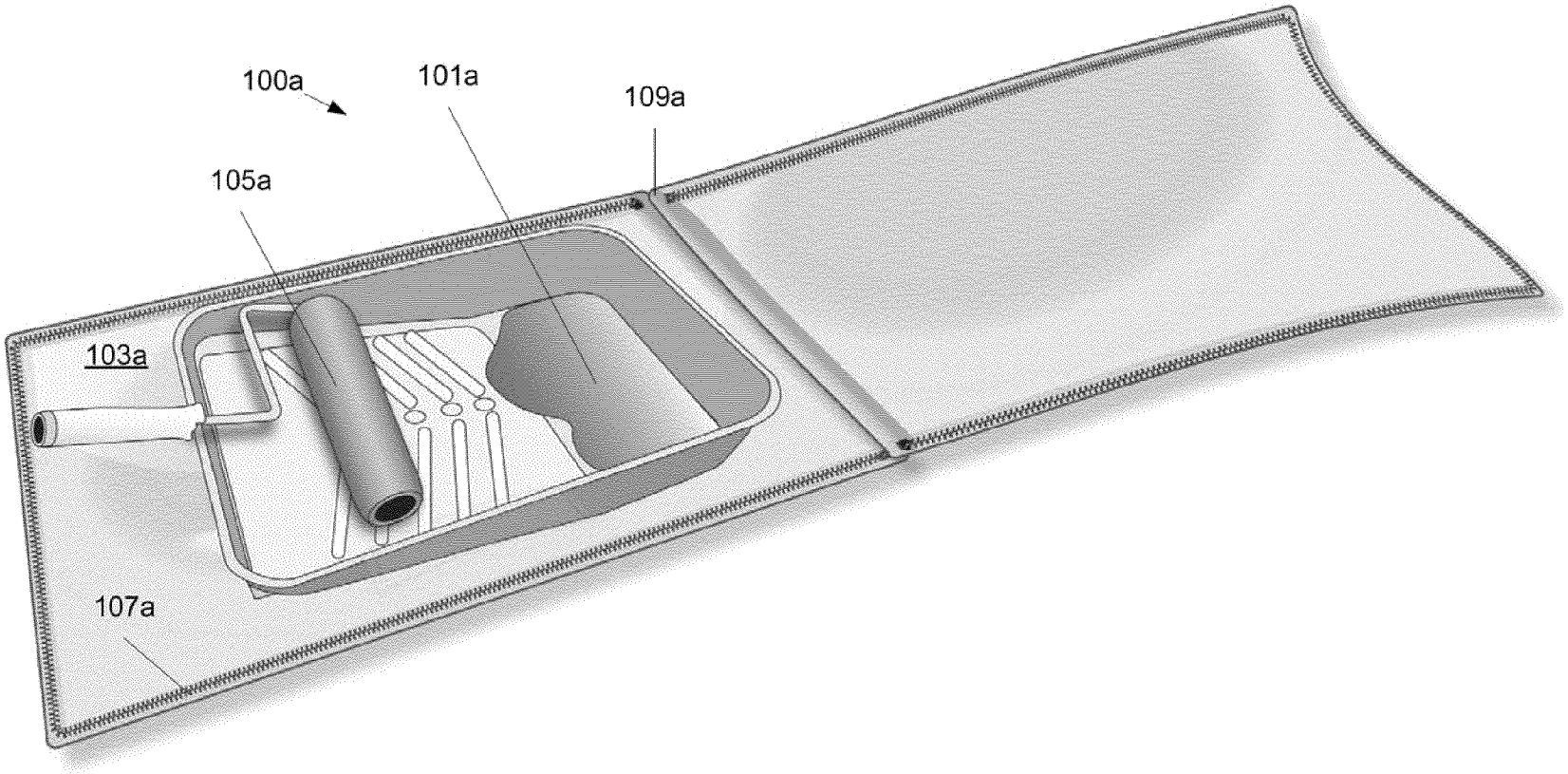
FIG. 11 depicts a paint tray bag in an open position, being used as a drop sheet for a paint tray, according to non-limiting implementations.
Figure 12:
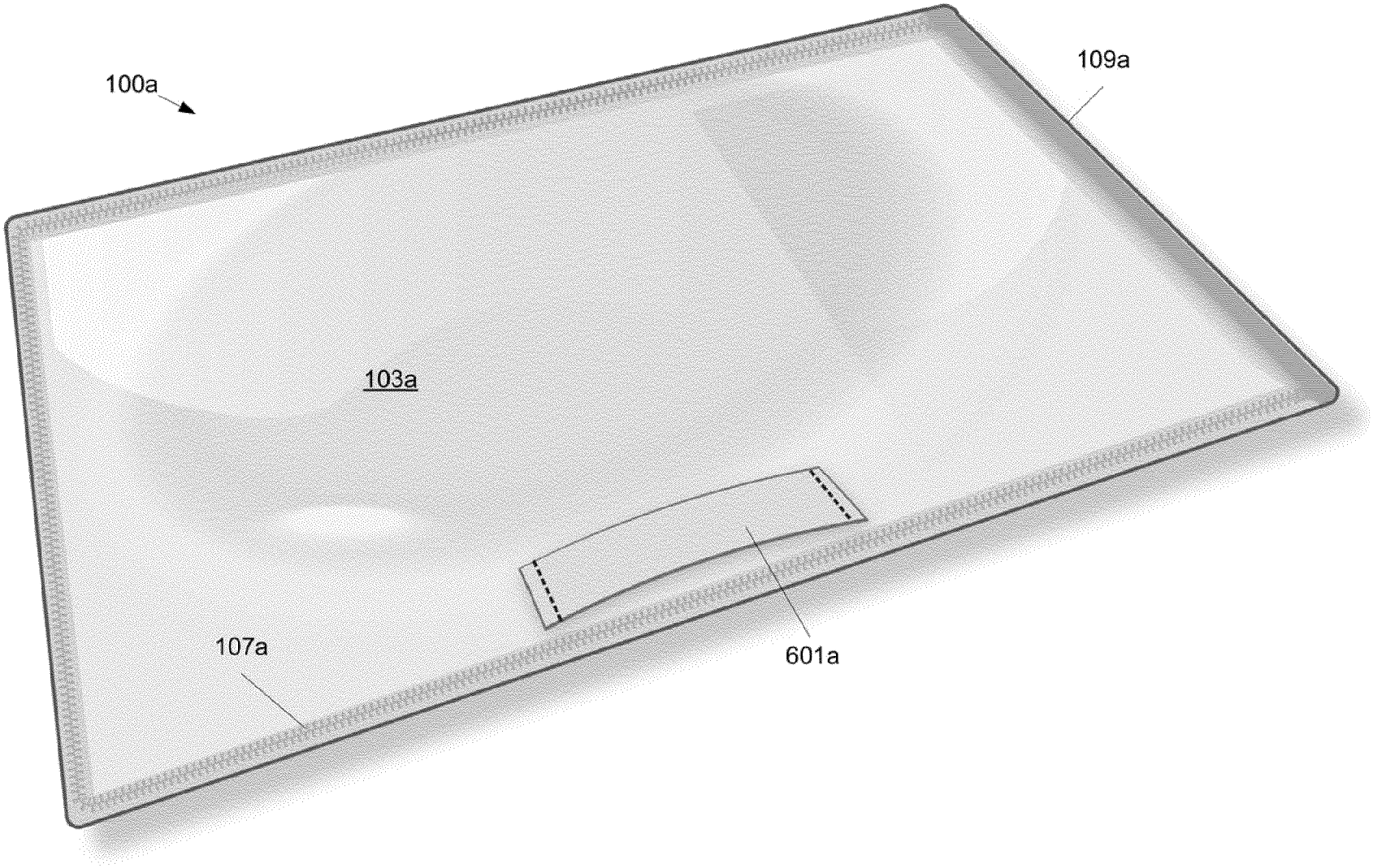
FIG. 12 depicts a handle on a paint tray bag, according to non-limiting implementations.
Figure 13:
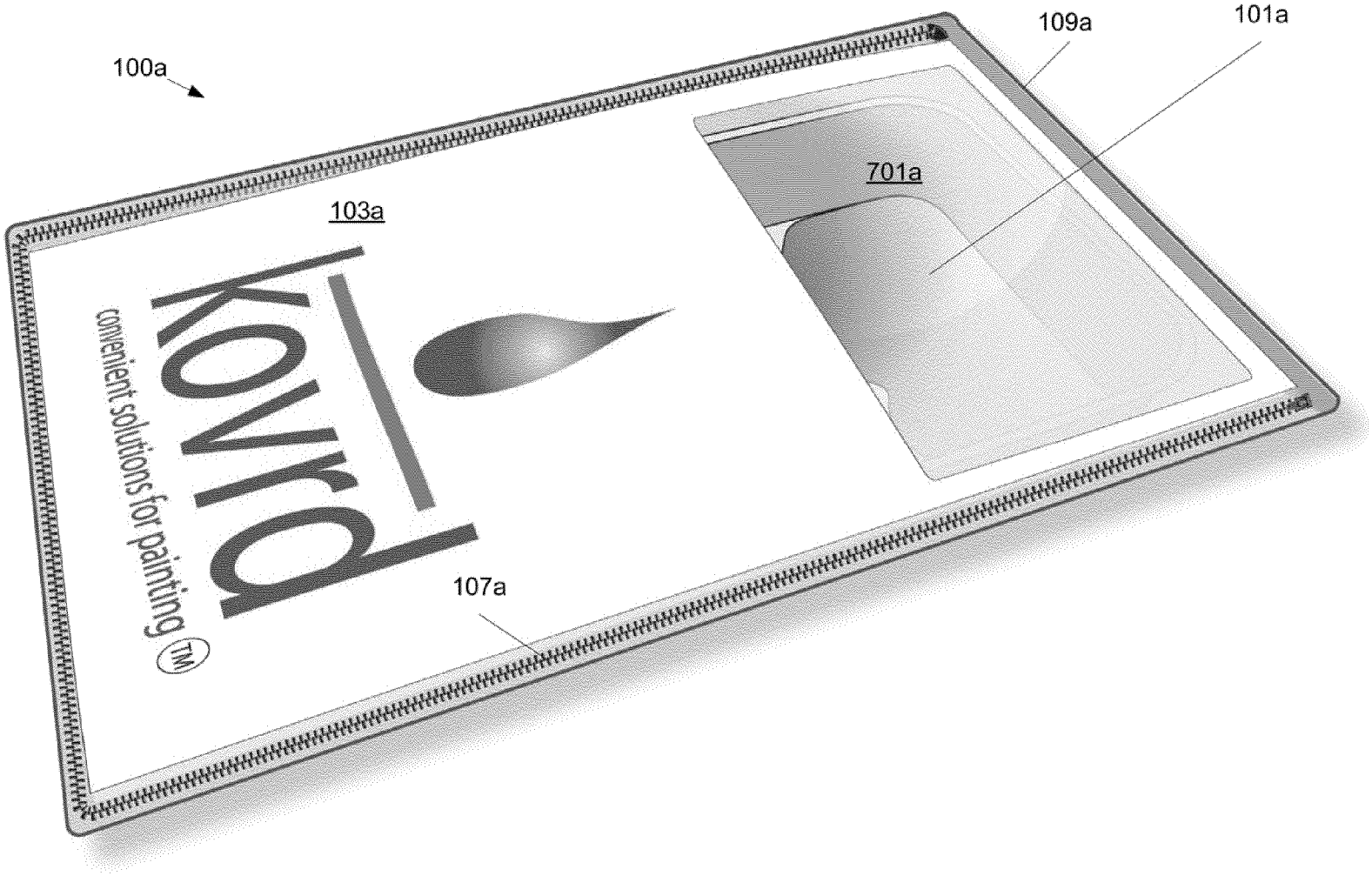
FIG. 13 depicts a window on a paint tray bag, according to non-limiting implementations.

In some implementations, as depicted in FIG. 7, which is substantially similar to FIGS. 1 and 2, with like elements having like numbers, paint tray bag 100 comprises a clear window 701, formed for example by the material of bag 103, with the remaining portion of bag 103 covered by printed artwork, advertising, coverage or the like, for example for education and explanation of function of paint tray bag 100. Window 701 enables a user to see inside paint tray bag 100 and identify materials contained therein (such as paint tray 101) and or a color of paint or the materials. Hence, for short term or long term storage the contents of paint tray bag 100 can be identified via clear window 701. Hence, when more than one paint tray bags 100 are used, window 701 enables a user painter to determine which paint tray bag 100 is storing which paint. In some embodiments, the printed artwork can comprise a labeling system so that a user can write on bag 103 and textually identify the materials/paints contained therein. Window 701 can comprise any suitable dimensions. In non-limiting implementations, window 701 comprises dimensions of approximately 7 inches by approximately 16 inches, though the dimensions of window 701 are not to be considered particularly limiting. In some implementations, window 701 comprises approximately 30% of bag 103, with the remaining 70% covered by any suitable artwork. In some implementations, window 701 is proximal a short edge of bag 103, though a location of window 701 is not to be considered particularly limiting.

Figure 14:
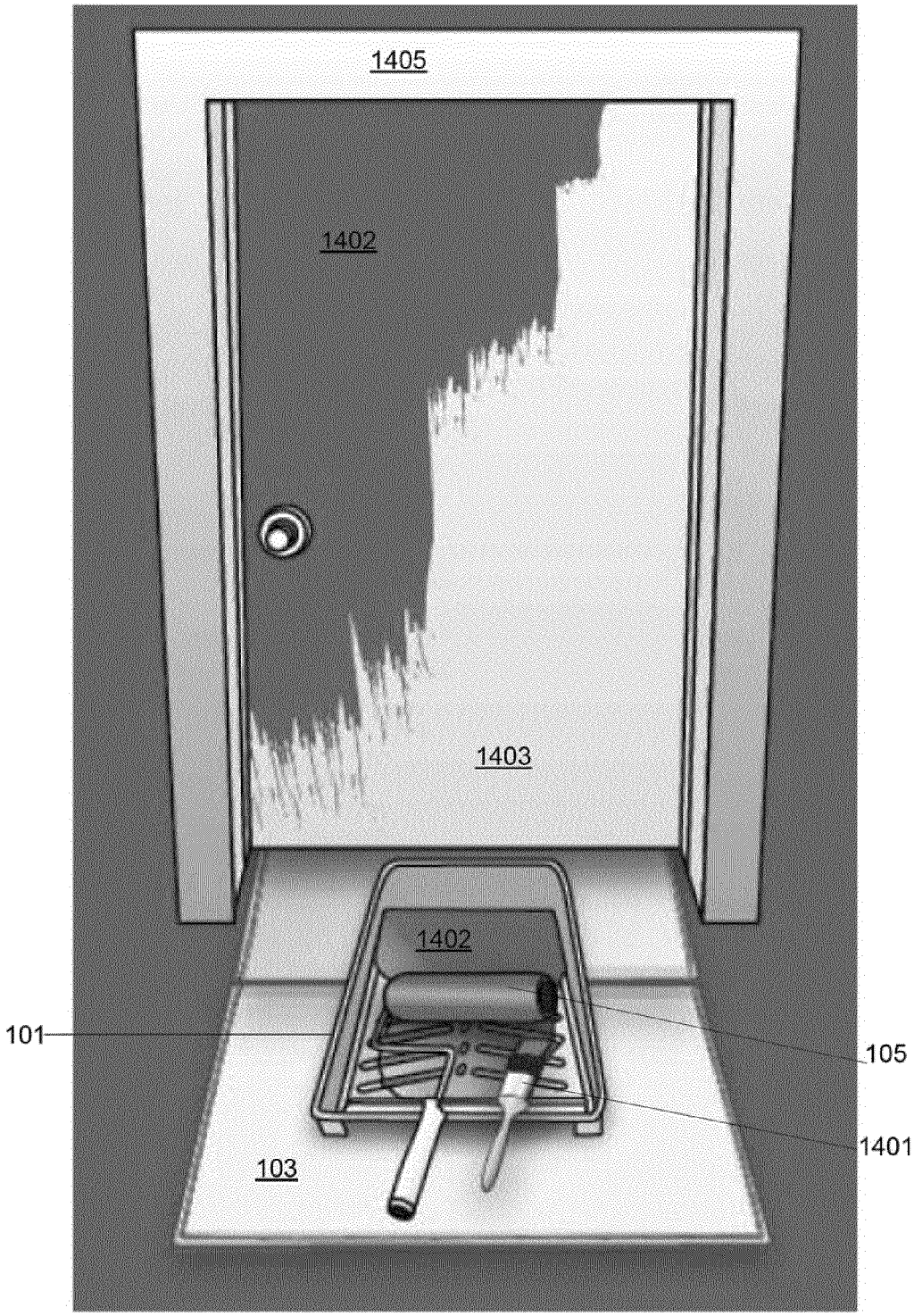
FIG. 14 depicts a paint tray bag in an open position being used as a drop sheet under a door, according to non-limiting implementations.

Attention is now directed to FIG. 14 which depicts bag 103 being used a drop sheet for paint try 101 and roller 105, as well as a brush 1401, with paint 1402 contained in paint tray 101 (with paint 1402 also depicted as being partially applied to door 1403). In particular, the dimensions of bag 103 enable bag 103 to be used a drop sheet with a door 1403. In other words, when painting door 1403, it is desirable to be able to slide a drop sheet under door 1403 (i.e. between door 1403 and the floor) such that paint can drop directly onto bag 103. It is appreciated that bag 103 comprises dimensions that enable bag 103 to be slid between door 1403 and the floor, and further to substantially extend along a bottom of door 1403. For example, in North America, a standard door width can comprise approximately 30 inches; as in some implementations bag 103 is approximately 30 inches wide by 40 inches long when in an open position, bag 103 can be slid under door 1403 and substantially extend the width of door 1403. Furthermore, FIG. 14 further depicts a door frame 1405, and bag 103 is appreciated to extend from one side of frame 1405, under door 1403, to an opposite side of frame 1405.

While present implementations have been described with respect to a North American 30 inch wide door, it is appreciated that width of doors can vary from jurisdiction to jurisdiction and even within a given jurisdiction. It is hence further appreciated that bag 103 can be adapted to any given door, such that at least one dimension of bag 103 is enabled to slide under the given door and extend along a width of the given door. Hence, the dimensions of bag 103 are not to be considered particularly limiting with regards to door widths.

In further implementations, bag 103 can also be used a drop sheet in a similar manner for a window, bag 103 extending along and/or through a window to act as drop sheet when window sills and/or areas above, below and around the window are being painted.

Attention is now directed to FIGS. 8, 9, 10, 11, 12, and 13, which are substantially similar to FIGS. 1, 2, 3, 5, 6, and 71 with like elements having like numbers however with an "a" appended thereto. For example, paint tray bag 100 is similar to paint tray bag 100*a*, however, sealing apparatus 107*a* runs across a first long edge of a bag 103*a*, along a first short edge of bag 103*a* and then back across a second long edge of bag 103*a*, such that bag 103*a* folds along a second short edge 109*a* in the open position. Hence, short edge 109*a* acts as a hinge similar to edge 109, however, in these implementations, paint tray bag 100*a* opens lengthwise (in contrast to paint tray bag 100 which opens width-wise). The resulting drop sheet hence has dimensions of approximately 60 inches by approximately 20 inches when bag 103*a* has dimensions of approximately 30 inches by approximately 20 inches. It is appreciated that when bag 103*a* has dimensions of approximately 30 inches by approximately 20 inches, bag 103*a* can also be used as a drop sheet for a door, as in FIG. 14, and/or a window, as described above, in either the open or closed position.

While implementations described herein refer to the paint tray bag having dimensions of 20"×30" when closed, these dimensions are not to be considered particularly limiting. For example, the dimensions of the paint tray bag can be of any suitable dimensions for storing a paint tray. As paint trays can come in various sizes, the paint tray bag can be manufactured with different dimensions to accommodate different sizes of paint trays. For example, the paint tray bag can have a width ranging from approximately 10 inches to approximately 60 inches and a length ranging from approximately 10 inches to approximately 60 inches".

Furthermore, paint tray bag 100 and/or paint tray bag 100*a* can be manufactured in different sizes to accommodate different sizes of paint trays, as well as various sizes of rollers, brushes or the like.

Attention is now directed to FIGS. 15A-D which depicted a paint tray bag 100*b* similar to paint tray bag 100. However, with reference to FIG. 15D, paint tray bag 100*b* comprises an extended drop sheet portion 1500 attached to bag 100*b*, extended drop sheet portion 1500 enabled to be stored in bag 100*b* and unfold from bag 100*b* to provide an extended area for the drop sheet (i.e. bag 100*b* in an open position). For example, as depicted in FIGS. 15B-D, the extended drop sheet portion 1500 is enabled to be stored in bag 100*b* in a pouch 1501. It is appreciated that while in FIGS. 15B-D pouch 1501 is located at a rear/back surface of bag 100*b*, in other implementations pouch 1501 can be located at a front of bag 1500. In each of these implementations, extended drop sheet 1500 can be accessed when bag 1500 is in the closed position. It is further appreciated that extended drop sheet 1500 can be made from the same material as bag 100*b* (as described above with reference to bag 100) or any other suitable material.

While not depicted, in yet further implementations, pouch 1501 can be located inside bag 100*b*, such that extended drop sheet 1500 can be accessed when bag 1500 is in the open position.

As depicted in FIGS. 15B-D, bag 100*b* further comprises a sealing apparatus 1503 for releasably sealing pouch 1501 when extended drop sheet 1500 is in pouch 1501, i.e. in a stored position. It is appreciated that in FIG. 15B, sealing apparatus 1503 is in a closed position, when extended drop sheet 1500 is stored in pouch 1501, while in FIG. 15D, sealing apparatus 1503 is in an open position, such that extended drop sheet 1500 can be unfolded and extend from pouch 1501.

FIG. 15C depicts detail of sealing apparatus 1503, and further shows a direction for opening sealing apparatus 1503, as indicated via arrows 1505*a*, 1505*b*, though a direction of opening is not to be considered particularly limiting. Further, while in FIG. 15C, sealing apparatus 1503 comprises a zipper apparatus, sealing apparatus 1503 can comprise any suitable apparatus for releasably sealing pouch 1501, including but not limited to, a ziplock, a zipper apparatus, a slider apparatus, a press and seal apparatus, Velcro™, and complimentary loop and hook apparatus.

It is further appreciated from FIGS. 15A-C that extended drop sheet 1500 is enabled to be stored in a folded position in bag 100*b* and/or in pouch 1501. For example, as depicted in FIG. 15D, extended drop sheet 1500 can accordion out from pouch 1501. It is yet further appreciated that in depicted implementations, extended drop sheet 1500 is enabled to unfold from bag 100*b* and/or pouch 1501 in a straight line, as indicated by line 1507.

Figure 16:
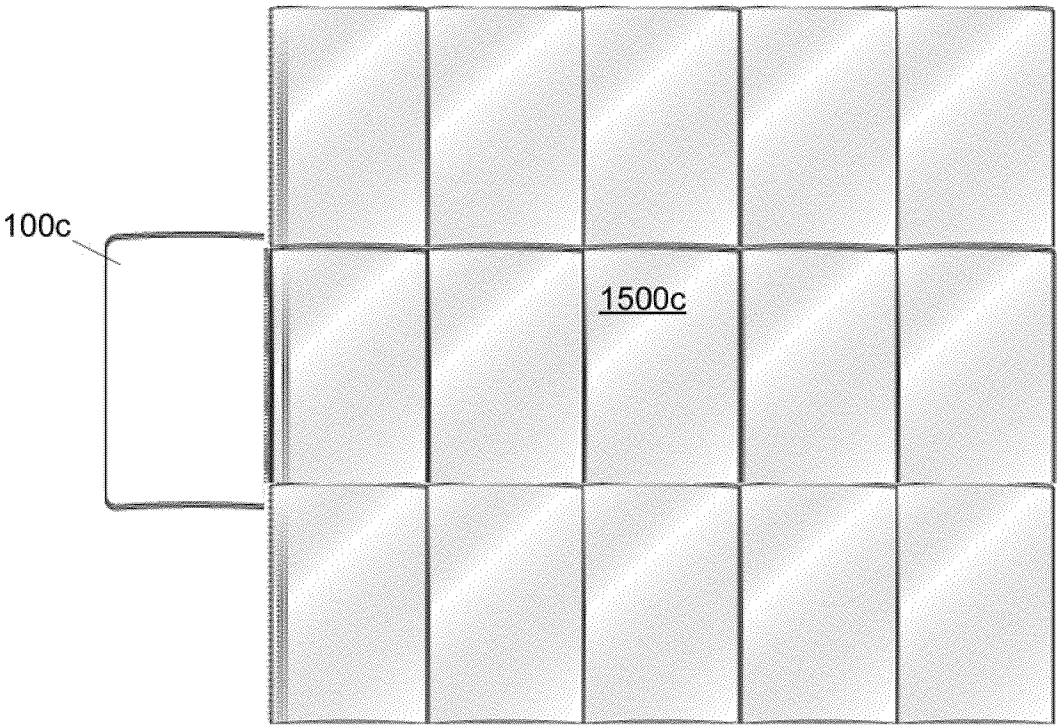
FIG. 16 depicts a paint tray bag with an extended drop sheet portion extending there from, according to non-limiting implementations.

Attention is now directed to FIG. 16, which depicts a bag 100*c* similar to bag 100*b* and comprising an extended drop sheet 1500*c* similar to extended drop sheet 1500, however extended drop sheet 1500*c* is further enabled to first unfold from bag 100*c* in a straight line and then unfold perpendicularly from the straight line, thereby further increasing the area of extended drop sheet 1500*c*, as compared to extended drop sheet 1500.

Figure 17:
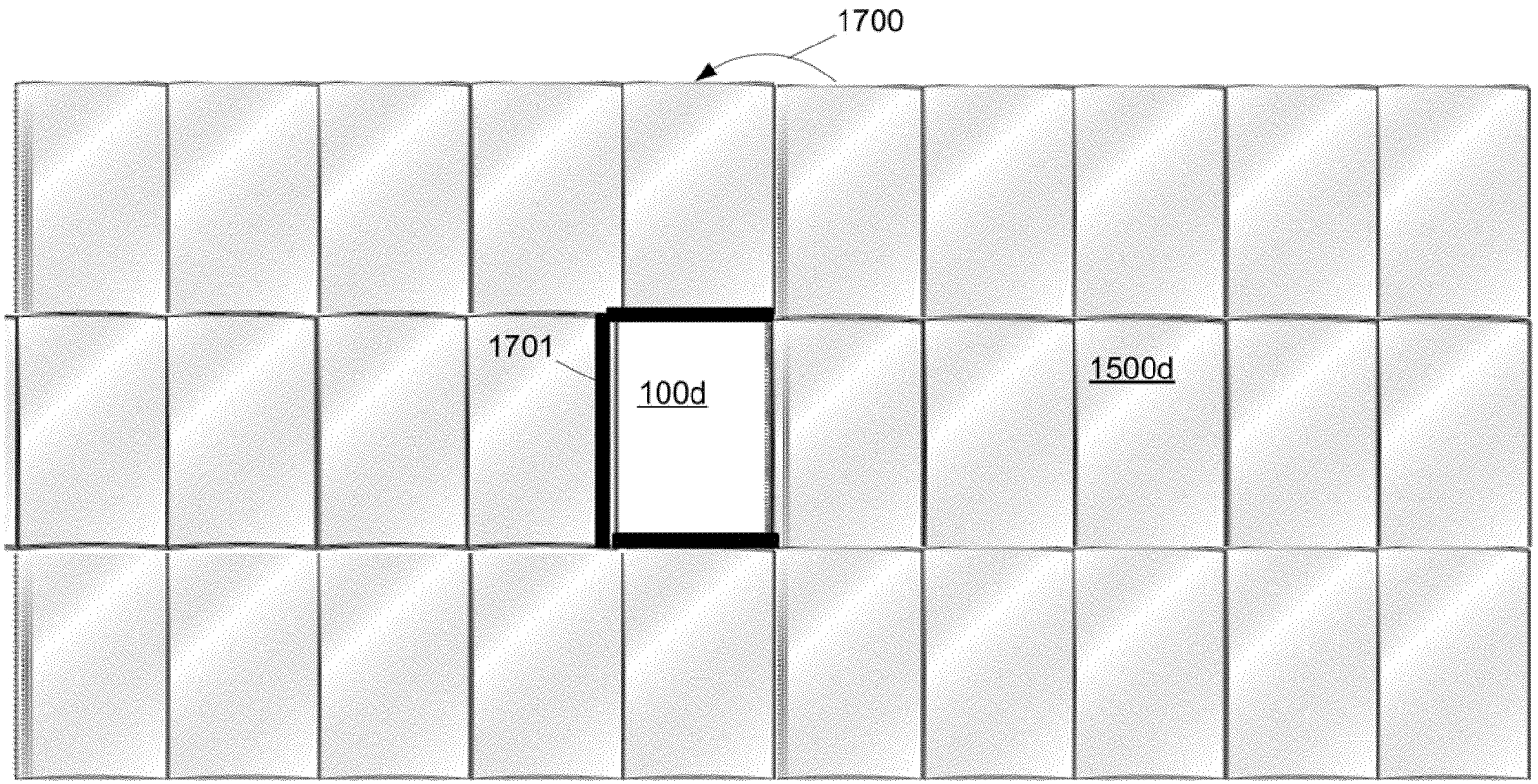
FIG. 17 depicts a paint tray bag with an extended drop sheet portion extending there from, according to non-limiting implementations.

Attention is now directed to FIG. 17, which depicts a bag 100*d*, similar to bag 100*c*, and comprising an extended drop sheet 1500*d* similar to extended drop sheet 1500*c*. However extended drop sheet 1500*d* is further enabled to further unfold around bag 100*d*, as indicated by arrow 1700, thereby further increasing the area of extended drop sheet 1500*d*, as compared to extended drop sheet 1500*c*. In these implementations edges of extended drop sheet 1500*d* that unfold around bag 100*d* are enabled to be releasably attachable to complimentary edges of bag 100*d*, for example via at least one of Velcro™ and complimentary loop and hook apparatus, though any suitable apparatus 1701 for releasably attaching the edges together are within the scope of present implementations. In other words, edges of extended drop sheet 1500*d* extend around bag 100*d* when extended drop sheet 1500*d* is unfolded around bag 100*d*, such that the edges of extended drop sheet 1500*d* and bag 100*d* at least one of overlap and touch, are provided with an apparatus 1701 for attaching each other thereto to prevent bag 100*d* and extended drop sheet 1500*d* from separating where they meet. It is appreciated, however, that extended drop sheet 1500*d* is nonetheless attached to bag 100*d* where extended drop sheet 1500*d* unfolds from bag 100*d*. It is further appreciated that while in FIG. 17 extended drop sheet 1500*d* extends entirely around bag 100*d*, in other implementations, extended drop sheet 1500*d* can unfold around only a portion of bag 100*d*, for example along one to three sides of bag 100*d*, rather than around all four sides as depicted, It is further appreciated, however, that extended drop sheets 1500, 1500*c* and 1500*d* can be releasably attached to respective bags 100*b*, 100*c*, 100*d* where extended drop sheets 1500, 1500*c* and 1500*d* unfolds from respective bags 100*b*, 100*c*, 100*d*, for example via any suitable apparatus, including but not limited to a frictional sealing apparatus, an elastic sealing apparatus, a watertight sealing apparatus, an airtight sealing apparatus, a ziplock, a zipper apparatus, a slider apparatus, a press and seal apparatus, Velcro™, and complimentary loop and hook apparatus. Hence, in these implementations, extended drop sheets 1500, 1500*c* and 1500*d* can be replaced with a new extended drop sheet of similar configuration, or a drop sheet of a different configuration. Indeed, it is appreciated that, in these implementations, extended drop sheets 1500, 1500*c* and 1500*d* can be modular, each of which can be stored in a respective bag 100*b*, 100*c*, 100*d* and/or pouch 1501.

Figure 18C:
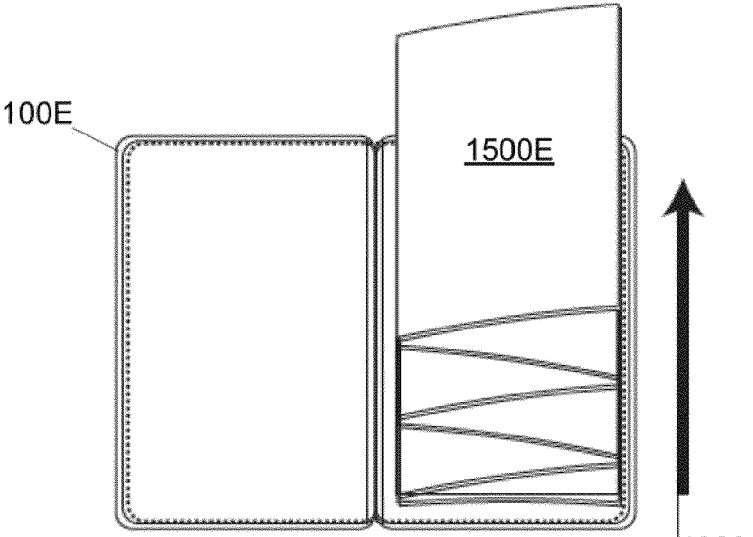
FIG. 18C depicts the paint tray bag of FIG. 18B in an open position with the extended drop sheet being unfolded there from, according to non-limiting implementations.
Figure 18B:
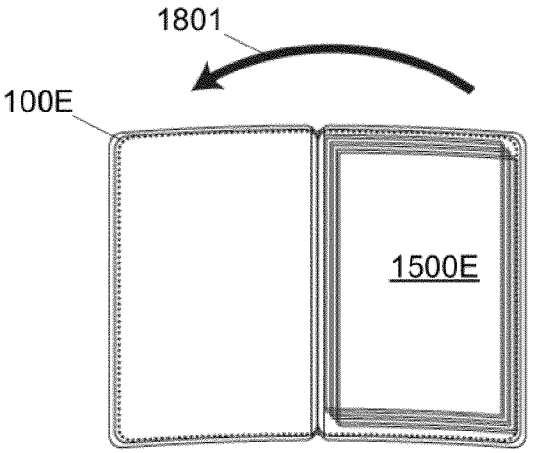
FIG. 18B depicts the paint tray bag of FIG. 18B in an open position with an extended drop sheet in a folded position therein, according to non-limiting implementations.
Figure 18A:
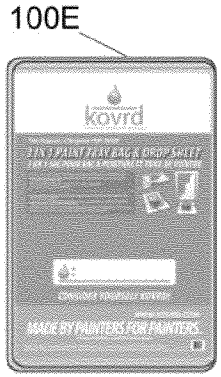
FIG. 18A depicts a front view of a paint tray bag in a closed position, according to non-limiting implementations.

Attention is next directed to FIGS. 18A-18D, which depicts a bag 100*e* similar to bag 100*b*, however bag 100*e* comprises an extended drop sheet 1500*e*, similar to extended drop sheet 1500 (or any of extended drop sheets 1500, 1500*c*, 1500*d*) enabled to be stored in a folded position in bag 100*e*. For example, FIG. 18A depicts bag 100*e* in a closed position, while FIG. 18B depicts bag 1500*e* in an open position (opening of bag 100*e* shown via arrow 1801), with extended drop sheet 1500*e* in a folded position therein. It is appreciated that a paint tray etc. can also be stored in bag 100*e* when extended drop sheet 1500*e* is stored therein, as described above with reference to bag 100.

Figure 18D:
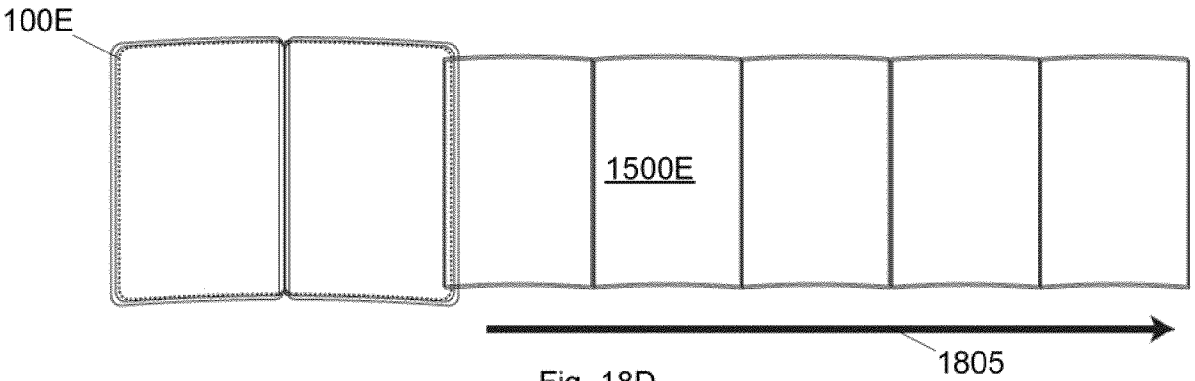
FIG. 18D depicts the paint tray bag of FIG. 18A with the extended drop sheet portion extending there from, according to non-limiting implementations.

FIG. 18C depicts extended drop sheet 1500*e* being unfolded from bag 100*e* (i.e. accordioned as per arrow 1803). FIG. 18D depicts extended drop sheet 1500*e* unfolded from bag 100*e*, as per arrow 1805. In other words, bag 100*e* does not necessarily comprise a pouch for storing extended drop sheet 1500*e*; rather extended drop sheet 1500*e* is stored in bag 100*e*.

Figure 19C:
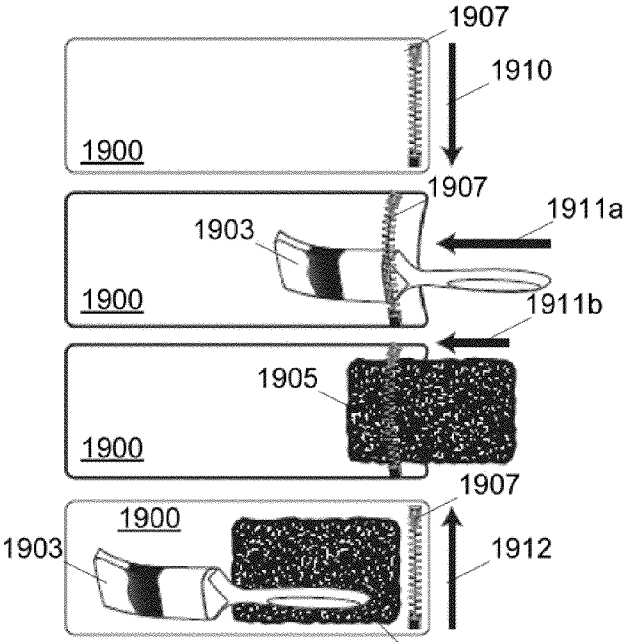
FIG. 19C depicts a sequence for inserting and sealing at least one of a paint brush and painting accessories in one or more pockets of the paint tray bag of FIG. 19A, according to non-limiting implementations.
Figure 19A:
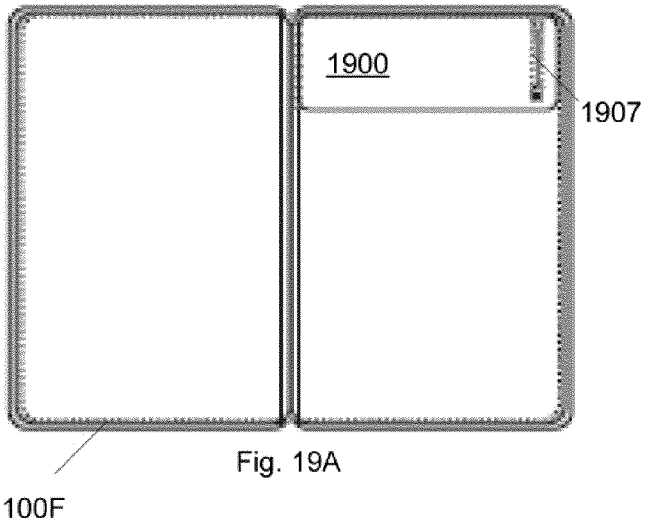
FIG. 19A depicts a paint tray bag in an open position including a one or more pockets enabled to contain at least one of paint brush and painting accessories, according to non-limiting implementations.
Figure 19B:
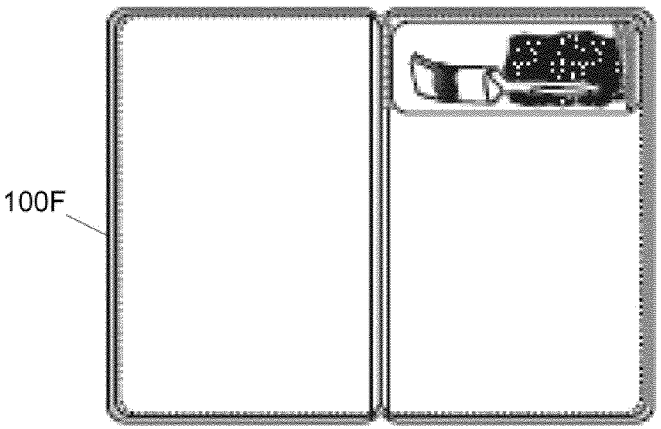
FIG. 19B depicts the paint tray bag of FIG. 19A in an open position with the one or more pockets containing at least one of paint brush and painting accessories, according to non-limiting implementations.

Attention is next directed to FIGS. 19A and 19B, which depict a bag 100F similar to at least one of bags 100-100*e*, however bag 100F comprises one or more pockets 1900, each of one or more pockets 1900 enabled to contain at least one of a paint brush 1903 and painting accessories 1905 (e.g. a sponge as depicted), such that when at least one of paint brush 1903 and painting accessories 1905 are wet with paint, one or more pockets 1900 prevent the paint from drying. In depicted implementations, bag 100*e* further comprises respective sealing apparatus 1907 for releasably sealing each of the one or more pockets 1900. The respective sealing apparatus 1907 can include, but is not limited to at least one of a ziplock, a zipper apparatus, a slider apparatus, a press and seal apparatus, Velcro™, and complimentary loop and hook apparatus.

It is appreciated that in FIGS. 19A and 19B, bag 100F is in open position and one or more pockets 1900 are located at inside surface of bag 100F. However, in other implementations, one or more pockets 1900 can be located at one or more of at a front of bag 100F, at a back of bag 100F, and inside bag 100F (e.g. at a front surface, at a back surface and/or at an inside surface).

One or more pockets 1900 can comprise any suitable material, which can be the same or different from bag 100F. In some implementation, pocket 1900 can comprise a hard plastic.

In some implementations, one or more pockets 1900 are removably attached to bag 100F, for example via an attachment apparatus including but not limited to Velcro™ and a loop and hook apparatus. However in depicted implementations, one or more pockets 1900 are integrally attached to bag 100F, for example using any suitable process, such as heat sealing one or more pockets 1900 to bag 100F.

FIG. 19C depicts a sequence for inserting and sealing at least one of a paint brush 1903 and painting accessories 1905 in one or more pockets 1900. For example, sealing apparatus 1907 is first opened (as indicated by arrow 1910); paint brush 1903 and/or painting accessories 1905 are inserted into one or more pockets 1900 (as indicated by arrows 1911*a*, 1911*b*); and then one or more pockets 1900 are sealed by closing sealing apparatus 1907 (as indicated by arrow 1912). As sealing apparatus 1907 seals pocket 1900, paint on paint brush 1903 and/or painting accessories 1905 remains wet.

One or more pockets 1900 can be any suitable size for containing paint brush 1903 and/or painting accessories 1905, and can be as small as approximately 1 inch by approximately 2 inches and as large as the dimensions of bag 100F in the closed position (e.g. similar to bag 100: see above for ranges of dimensions of bag 100).

It is appreciated that in some implementations, pocket 1900 can be enabled to contain bristles of brush 1903 and further seal around the bristles but not the handle (e.g. similar to FIG. 19*c*, though pocket 1900 as depicted can contain all of brush 1903). Such implementations would prevent paint from getting on the handle of brush 1903. It is appreciated that, in these implementations, sealing apparatus 1907 can be enabled to seal around a portion of brush 1903 from which the bristles extend and/or any other suitable potion of brush 1903 and can comprise any suitable apparatus including, but not limited to, a frictional sealing apparatus, an elastic sealing apparatus and the like.

It is yet further appreciated that each of bags 100-100*e* can be provided with any suitable number of extended drop sheets of any suitable configuration (with our without a respective pouches as desired) and/or any suitable number of pockets for holding paint accessories.

It is yet further appreciated that one or more of sealing apparatus 107, 107*a*, 1503 and 1907 can comprise at least one of a watertight sealing apparatus and an airtight sealing apparatus, including but not limited to a waterproof zipper and the like. Correspondingly, one or more of bags 100-100*e*, pouch 1501 and pocket 1900 can be at least one of watertight and airtight. For example, in implementations where of bag 100 (and/or any of bags 100-100*e*) are at least one of watertight and airtight, when a paint tray containing paint is stored therein and bag 100 is sealed via sealing apparatus 107, spills of paint from the paint tray stored therein are contained within bag 100.

It is further appreciated that an extended drop sheet of any suitable configuration as described can be provided in a pouch similar to pouch 1501 described herein without a bag, and that the pouch containing the extended drop sheet can be used alone and/or be attachable to a bag similar to any of bags 100-100*e*. In these implementations, an apparatus for holding a drop sheet is provided comprising a pouch for containing a drop sheet; a sealing apparatus for releasably sealing the pouch; and a drop sheet attached to the pouch, the drop sheet portion enabled to be stored in the pouch and unfold from the pouch. The pouch can be enabled for attachment to a resealable bag for containing a paint tray therein.

Present implementations hence provide a resealable and reusable solution for storing paint trays, to prevent the drying of paints/materials and to protect the surrounding environment from the potential dangerous and costly spilling of paint and materials. Furthermore, it is appreciated that paint tray bags as described herein enable a painter to stop mid-job, seal up their paint tray and equipment, leaving paint/materials wet and ready to use in the paint tray, and then continue where they left off by opening the paint tray bag with the paint tray contained therein. The paint tray bag described herein, further provides protection to the surrounding environment by isolating paint and paint equipment which could potentially come into contact with unwanted surfaces as the paint tray bag opens from a closed position, where the paint tray bag is sealed therein, to an open position, wherein the paint tray bag opens flat thereby converting the bag into a painters drop sheet. The extended drop sheet extends the area of the bag when used a drop sheet. The pouch attached to the bag provides a convenient apparatus for storing paint accessories to keep them from drying out.

Persons skilled in the art will appreciate that there are yet more alternative implementations and modifications possible for implementing the implementations, and that the above implementations and examples are only illustrations of one or more implementations. The scope, therefore, is only to be limited by the claims appended hereto.

What is claimed is:

1. A paint tray bag, comprising:

a bag comprising dimensions for containing a paint tray therein, said bag being impermeable to paint;

a sealing apparatus for releasably sealing the bag to prevent the paint from drying out when the paint tray is sealed in said bag, the sealing apparatus around at least portion of a perimeter of the bag such that the bag comprises a closed position for containing the paint tray therein when the sealing apparatus is closed and an open position when the sealing apparatus is open, the bag enabled to lay flat in the open position to act as a drop sheet for the paint tray; and an extended drop sheet portion attached to the bag, the extended drop sheet portion enabled to be stored in the bag and unfold from the bag to provide an extended area for the drop sheet, said extended drop sheet enabled to be stored in a folded position in said bag and accordion out from said bag to an unfolded position.

2. The paint tray bag of claim 1, wherein the extended drop sheet portion is enabled to be stored in the bag within a pouch.

3. The paint tray bag of claim 2, wherein the pouch is one of: at a front of the bag and at a back of the bag, such that the extended drop sheet can be accessed when the bag is in the closed position.

4. The paint tray bag of claim 2, wherein the pouch is located inside the bag, such that the extended drop sheet can be accessed when the bag is in the open position.

5. The paint tray bag of claim 2, further comprising a second sealing apparatus for releasably sealing the pouch when the extend drop sheet is in the pouch.

6. The paint tray bag of claim 5, wherein the second sealing apparatus comprises at least one of a frictional sealing apparatus, an elastic sealing apparatus, a watertight sealing apparatus, an airtight sealing apparatus, a ziplock, a zipper apparatus, a slider apparatus, a press and seal apparatus, and complimentary loop and hook apparatus.

7. The paint tray bag of claim 5, wherein the bag comprises a length of approximately 30 inches and a width of approximately 20 inches.

8. The paint tray bag of claim 1, wherein the extended drop sheet is further enabled to be stored in a folded position in the bag.

9. The paint tray bag of claim 1, wherein the extended drop sheet is further enabled to unfold from the bag in a straight line.

10. The paint tray bag of claim 1, wherein the extended drop sheet is further enabled to first unfold from the bag in a straight line and then unfold perpendicularly from the straight line.

11. The paint tray bag of claim 1, wherein the extended drop sheet is further enabled to unfold around the bag.

12. The paint tray bag of claim 11, wherein edges of the extended drop sheet that unfold around the bag are enabled to be releasably attachable to complimentary edges of the bag.

13. The paint tray bag of claim 11, wherein the edges of the extended drop sheet and the complimentary edges of the bag comprise complimentary loop and hook apparatus.

14. The paint tray bag of claim 1, further comprising one or more pockets located on an inside surface of said bag, each of the one or more pockets enabled to contain at least one of a paint brush and painting accessories, such that when at least one of the paint brush and the painting accessories are wet with paint, the pocket prevents the paint from drying.

15. The paint tray bag of claim 14, further comprising respective sealing apparatus for releasably sealing each of the one or more pockets, said respective sealing apparatus accessible only when said bag is in said open position.

16. The paint tray bag of claim 15, wherein the respective sealing apparatus comprises at least one of a frictional sealing apparatus, an elastic sealing apparatus, a watertight sealing apparatus, an airtight sealing apparatus, a ziplock, a zipper apparatus, a slider apparatus, a press and seal apparatus, and complimentary loop and hook apparatus.

17. The paint tray bag of claim 14, wherein the one or more pockets are located at one or more of at a front of the bag, at a back of the bag, and inside the bag.

18. The paint tray bag of claim 1, wherein the bag comprises a length between 10 and 60 inches and a width between 10 and 60 inches.

19. The paint tray bag of claim 1, wherein a material of the bag is approximately 0.01 inches to approximately 0.1 inches thick.

20. The paint tray bag of claim 1, further comprising a handle for at least one of hanging the bag and carrying the bag.

* * * * *